US005748174A

United States Patent [19]

Wong et al.

[11] Patent Number: 5,748,174

[45] Date of Patent: May 5, 1998

[54] VIDEO DISPLAY SYSTEM INCLUDING GRAPHIC LAYERS WITH SIZABLE, POSITIONABLE WINDOWS AND PROGRAMMABLE PRIORITY

[75] Inventors: Wai-sing Wong, TSZ Wan Shan; Kam-chi Chao; Chi-ming Fong, both of Tai Po, all of Hong Kong

[73] Assignee: VTech Electronics, Ltd., Hong Kong

[21] Appl. No.: 763,871

[22] Filed: Dec. 11, 1996

Related U.S. Application Data

[63] Continuation of Ser. No. 549,306, Oct. 27, 1995, abandoned, which is a continuation of Ser. No. 204,062, Mar. 1, 1994, abandoned.

[51] Int. Cl.[6] ..... G09G 5/00

[52] U.S. Cl. ..... 345/118; 345/120; 395/134

[58] Field of Search ..... 345/118–126; 395/134, 340, 343, 345; 365/189.04, 230.05

[56] References Cited

U.S. PATENT DOCUMENTS

| | | | |
|---|---|---|---|
| 4,116,444 | 9/1978 | Mayer et al. | 273/101.2 |
| 4,232,374 | 11/1980 | Chung et al. | 364/900 |
| 4,243,984 | 1/1981 | Ackley et al. | 340/703 |
| 4,296,476 | 10/1981 | Mayer et al. | 364/900 |
| 4,317,114 | 2/1982 | Walker | 340/721 |
| 4,439,760 | 3/1984 | Fleming | 340/799 |
| 4,498,079 | 2/1985 | Ghosh et al. | 340/725 |
| 4,559,533 | 12/1985 | Bass et al. | 345/120 |
| 4,626,839 | 12/1986 | O'Malley | 340/750 |
| 4,736,309 | 4/1988 | Johnson et al. | 345/120 X |
| 4,811,245 | 3/1989 | Bunker et al. . | |
| 4,870,621 | 9/1989 | Nakada | 365/230.05 |
| 4,951,038 | 8/1990 | Yamamura | 340/725 |
| 4,954,970 | 9/1990 | Walker et al. | 364/521 |
| 5,089,811 | 2/1992 | Leach | 340/703 |
| 5,091,969 | 2/1992 | Kuwashima | 345/120 X |
| 5,129,055 | 7/1992 | Yamazaki et al. | 345/120 X |
| 5,241,656 | 8/1993 | Loucks et al. | 345/120 X |

*Primary Examiner*—Amare Mengistu
*Attorney, Agent, or Firm*—Dick and Harris

[57] ABSTRACT

A graphic video display system including at least one graphic layer having sizable, positionable windows and programmable priority values the sprites having fixed priority values. Portions of graphic layer windows and sprites which overlap with a current horizontal scan line of a video display are written to a line buffer. Overlapping objects are resolved by writing portions of objects overlapping the current horizontal scan line to the line buffer in order of the priority values of the objects.

6 Claims, 8 Drawing Sheets

Fig 4
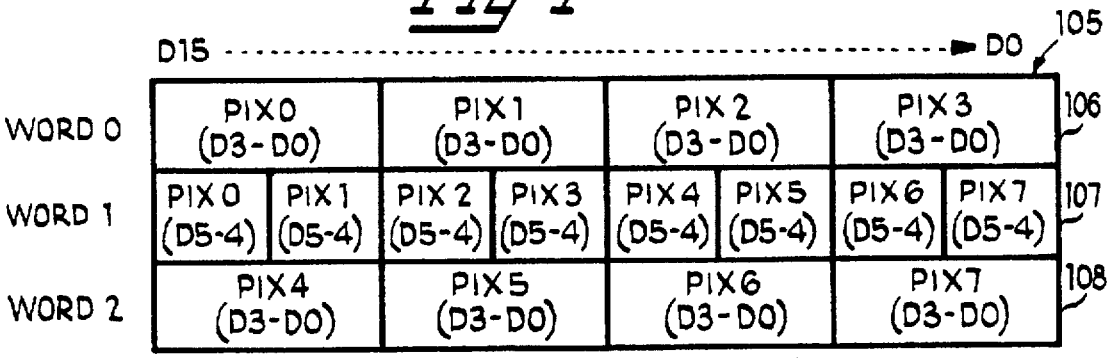
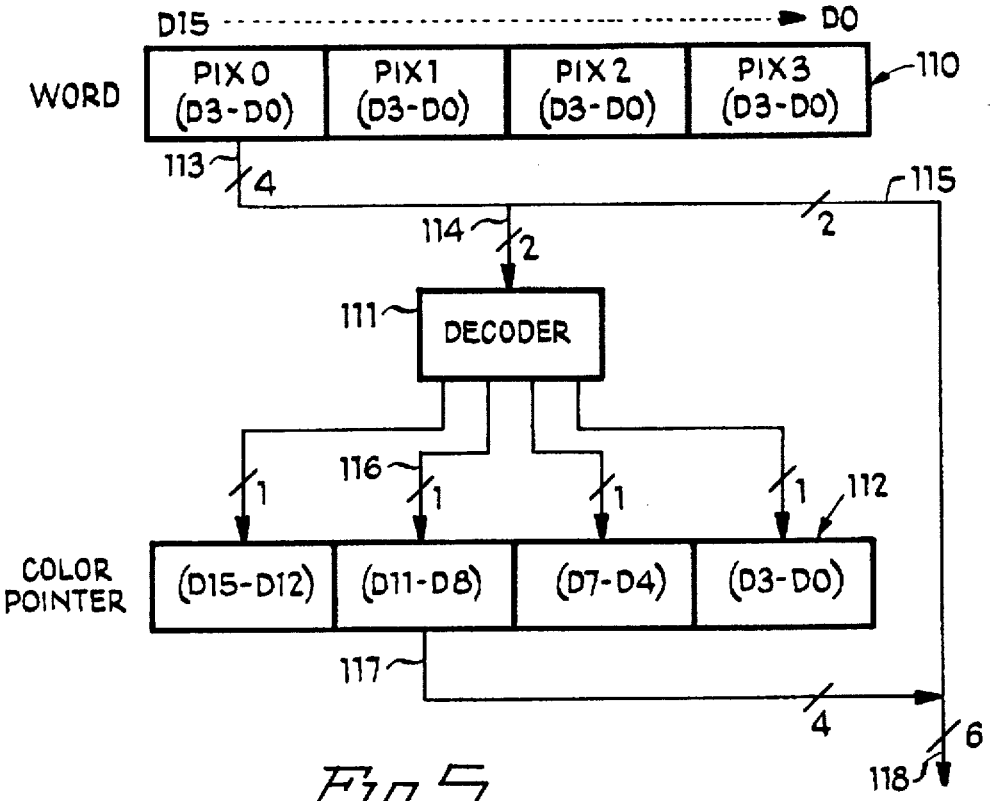
Fig 5

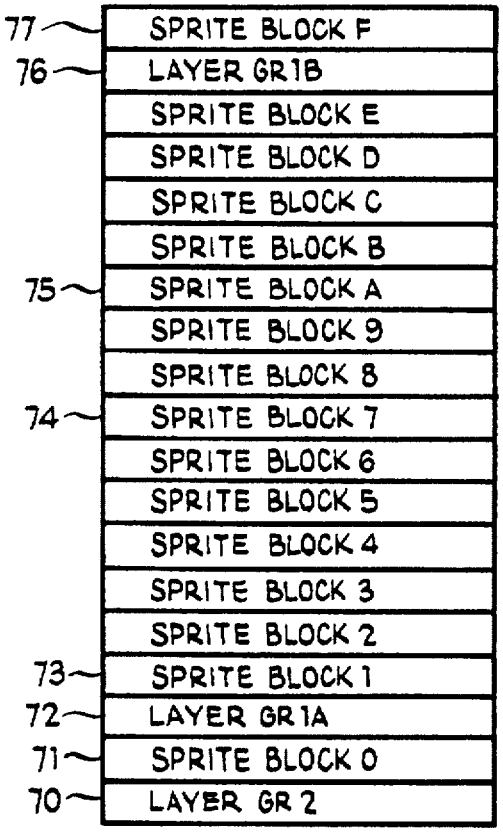
Fig 11
Fig 12
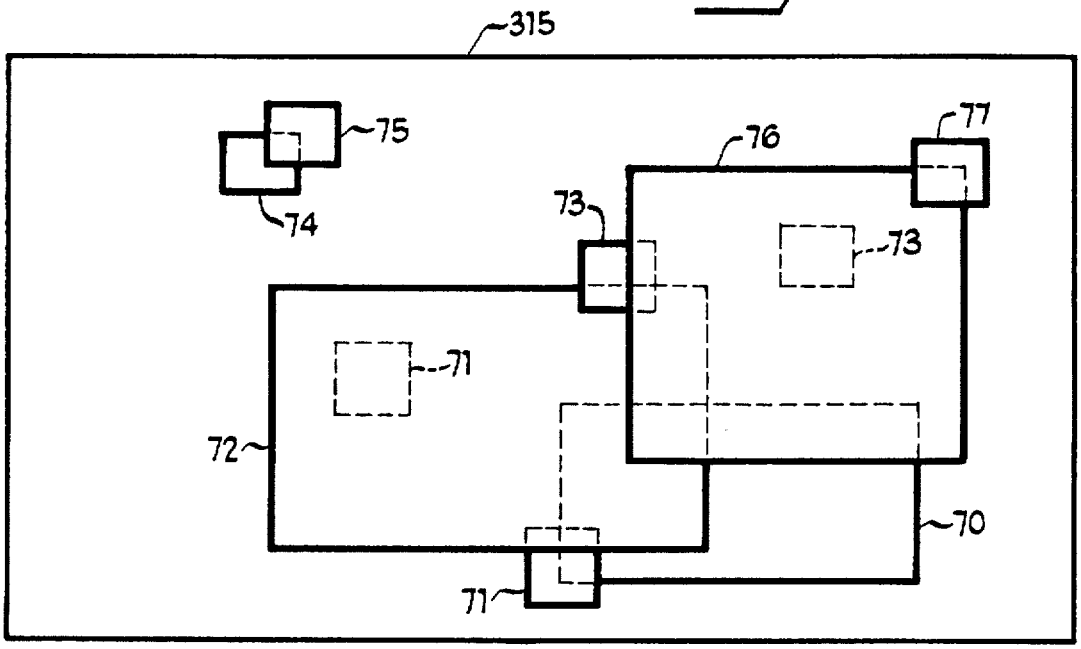

S1
202
216
217
S2
212
218
S3
213
219
220
S4
214
221
215
S7
222
223
224
225
226
SØ
S33
S15
S8
S43
201
205
203
204
211

S8
204
245
246
S9
241
247
S10
242
248
249
S11
243
250
244
S14
251
252
253
SØ
S33
S43
201
205
211

100
400
DRAM
54
420
X/NAME BUFFER
421
422
410
Y BLOCK BUFFER
450
SPRITE BLOCK COUNTER
451
452
90
91
CURRENT LINE COUNTER
411
460
SPRITE SUB-BLOCK COUNTER
461
462
430
440
SUBTRACTOR
Y DISCRIMINATOR
SPRITES WRITTEN COUNTER
471
470
431
441

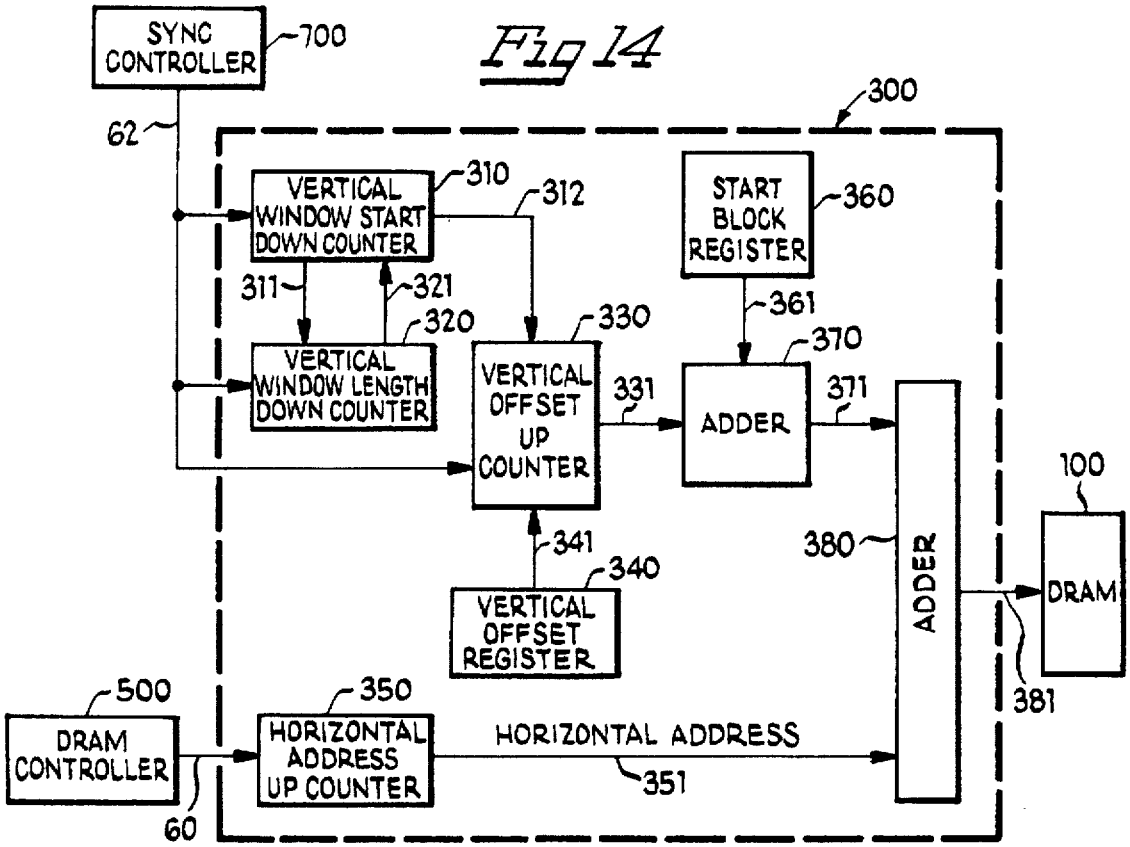
Fig 14
SYNC CONTROLLER
700
62
300
VERTICAL WINDOW START DOWN COUNTER
310
312
START BLOCK REGISTER
360
311
321
361
320
330
370
VERTICAL WINDOW LENGTH DOWN COUNTER
VERTICAL OFFSET UP COUNTER
331
ADDER
371
100
341
340
380
ADDER
DRAM
VERTICAL OFFSET REGISTER
381
500
350
DRAM CONTROLLER
HORIZONTAL ADDRESS UP COUNTER
HORIZONTAL ADDRESS
351
60

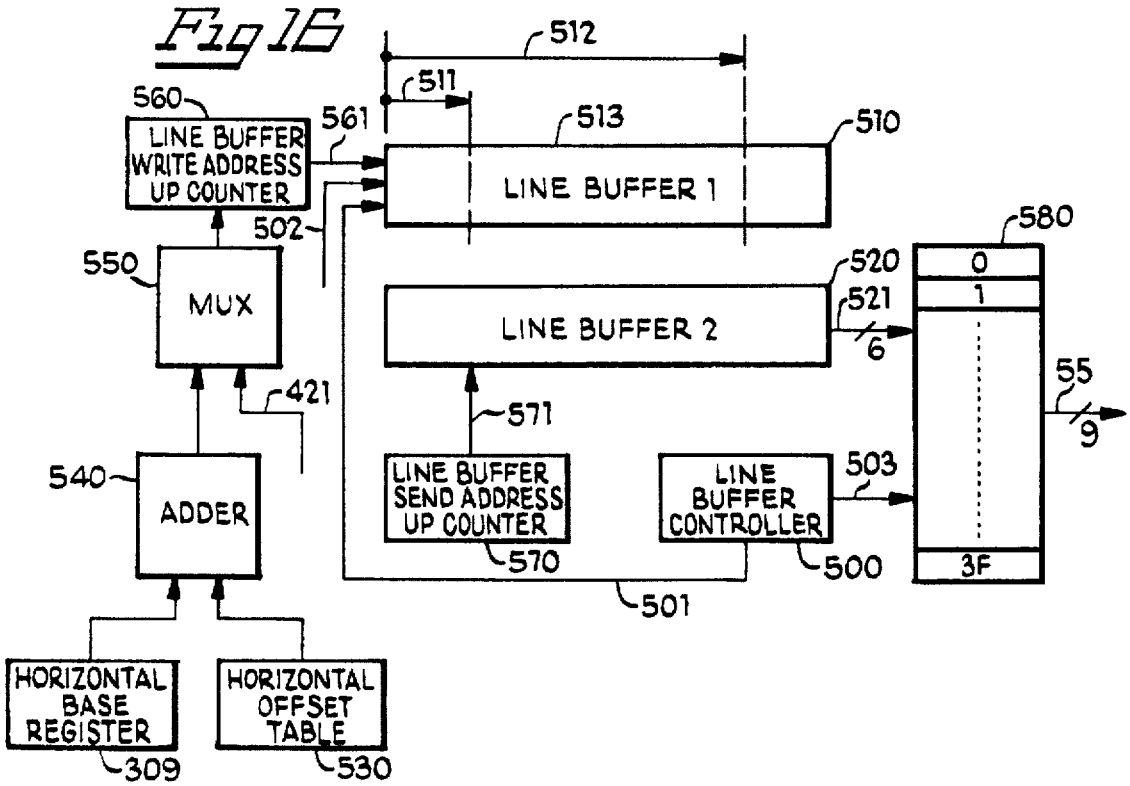
Fig 16
512
511
560
561
513
510
LINE BUFFER WRITE ADDRESS UP COUNTER
LINE BUFFER 1
502
580
550
MUX
520
0
521
1
LINE BUFFER 2
6
55
421
571
9
540
ADDER
LINE BUFFER SEND ADDRESS UP COUNTER
LINE BUFFER CONTROLLER
503
570
500
3F
501
HORIZONTAL BASE REGISTER
HORIZONTAL OFFSET TABLE
309
530

VIDEO DISPLAY SYSTEM INCLUDING GRAPHIC LAYERS WITH SIZABLE, POSITIONABLE WINDOWS AND PROGRAMMABLE PRIORITY

This is a continuation of application Ser. No. 08/549,306, filed Oct. 27, 1995, now abandoned, which is a continuation of application Ser. No. 08/204,062 filed Mar. 1, 1994, now abandoned.

BACKGROUND OF THE INVENTION

The present invention relates in general to graphic video display systems, and, more particularly, to a graphic video display system having graphic layers with programmable priority and window sizing.

Graphic video display systems have been known in the art for many years. Such devices are typically employed, for example, within video games, personal computers, and computer workstations. Some graphic display systems visually display multiple layers of text and graphic data within sizable windows. An example of such a graphic display system is the combination of an IBM PC-compatible computer and the Microsoft WINDOWS operating system. These prior art systems typically employ a bit-mapped display buffer at least as large as the number of pixels displayed upon an associated video monitor. Objects to be displayed, such as overlapping windows of data, are all written to the common display buffer.

Some prior art graphic display systems support overlapping windows. Within these systems, varying portions of displayable windows may be displayed at any given time, depending upon the size, positioning, and degree of overlap of the various windows. Accordingly, two separate copies of each window, or other displayable object, are maintained; an entire copy stored within a non-displayable region of memory, and the portion presently displayed, stored within a display buffer.

These prior art graphic display systems typically construct a video display of multiple objects, such as windows, by writing data representing the contents of each window sequentially to the display buffer. Objects of lower display priority are written first, and are subsequently overwritten, or obscured, by overlapping portions of higher display priority objects.

The present invention overcomes the requirement, within some prior art systems capable of displaying multiple overlapping objects, of a common display buffer at least as large as the number of pixels displayed upon the video monitor. Rather, a display buffer the size of a single horizontal scan line is employed. As each horizontal scan line is displayed, the present invention determines the portions of displayable objects which overlap with the present scan line, and write those portions to a single-line display buffer, in order of increasing display priority. In this manner, the requirement and expense of a full-screen display buffer is avoided.

Accordingly, it is an object of the present invention to provide a graphic display system having multiple overlapping objects and a single-line display buffer.

It is another object of the present invention to provide a graphic display system having graphic layers with sizable, positionable windows.

It is a further object of the present invention to provide a graphic display system having graphic layers with programmable display priority.

It is yet another object of the present invention to provide a graphic display system having sprite graphics which may be interspersed with graphical layers.

These and other objects and features of the present invention will become apparent in light of the present specification, drawings and claims.

SUMMARY OF THE INVENTION

The present invention comprises a graphic video display system including at least one graphic layer. Each of the graphic layers includes a 2-dimensional array of displayable elements visually displayable as pixels upon a video display. The video display comprises a plurality of horizontal scan lines, including a first horizontal scan line, a last horizontal scan line, and a current horizontal scan line. The current horizontal scan line corresponds to a horizontal scan line to be next displayed.

A first memory means stores a digital representation of the displayable elements of the graphic layer. A second memory means stores a digital representation of the current horizontal scan line. Horizontal sequencing means sequences from the first horizontal scan line to the last horizontal scan line.

Programmable window means specifies a displayable portion of an associated graphic layer. The programmable window means includes means for specifying horizontal boundaries and vertical boundaries of the displayable portion of the graphic layer.

The graphic video display system further includes means for determining whether a region defined by the vertical boundaries of the displayable portion of a graphic layer overlaps with the current horizontal scan line. The system further includes means for reading a displayable portion of a graphic layer which overlaps with the current horizontal scan line from the first memory means, and means for writing a subset of the displayable portion of a graphic layer which overlaps with the current horizontal scan line to the second memory means. This subset is a segment which is positioned between the horizontal boundries.

In addition, the present graphic video display system includes means for displaying a digital representation of a horizontal scan line upon a corresponding horizontal scan line of the video display.

Accordingly, only the portion of a graphic layer which is specified as displayable by the programmable window means is displayed upon the video display. This portion of the graphic layer is displayed upon the video display at a position specified by the horizontal and vertical boundaries.

In the preferred embodiment, the graphic video display system includes at least two graphic layers, and further includes priority resolving means. The priority resolving means determines, at positions on the video display where there is an overlap of the displayable portions of at least two graphic layers, which of the displayable portions of the graphic layers are to be displayed on the video display.

Associated with the priority resolving means is priority assigning means for assigning one of a range of priority values to each of the graphic layers. These priority values may correspond to a value ranging from a lowest priority value to a highest priority value. Also associated with the priority resolving means is priority sequencing means. The priority sequencing means sequences from the lowest priority value to the highest priority value. In addition, the priority sequencing means has a current priority value.

Moreover, in the preferred embodiment, the subset of the displayable portion of a graphic layer which overlaps with the current horizontal scan line is only written to the second memory means when the current priority value is equal to the priority value assigned to that graphic layer.

Accordingly, displayable portions of each of the graphic layers which overlaps with the current horizontal scan line are sequentially written to the second memory means. This sequential writing of graphic layers occurs in order of increasing priority value assigned to the graphic layer. Thus, graphic layers assigned lower priority values are at least partially obscured by overlapping graphic layers which are assigned higher priority values.

Also in the preferred embodiment, the present graphic display system further includes at least one displayable sprite. Each sprite has an x-coordinate, a y-coordinate, a priority value, and an associated sprite pattern. The graphic display system further includes means for determining whether a portion of a sprite overlaps with the current horizontal scan line, and means for determining whether a sprite has a priority value which is equal to the current priority value. In addition, means are provided for writing a subset of the sprite pattern to the second memory means. This subset corresponds to the portion of a sprite which overlaps with the current horizontal scan line, and which has a priority value equal to the current priority value.

As a result, displayable portions of each of the graphic layers and each of the sprites overlapping the current horizontal scan line are each sequentially written to the second memory means. This sequential writing occurs in order of increasing priority value. Accordingly, graphic layers and sprites having a lower priority value are at least partially obscured by overlapping graphic layers and sprites which have a higher priority value. This priority resolution of graphic layers and sprites, along with the assignment of variable priority values to the graphic layers, allows the graphic layers and sprites to be interspersed, as perceived upon the video display.

In the preferred embodiment, the graphic display system further includes horizontal scrolling means for horizontally scrolling the displayable elements of a graphic layer within the window, or displayable portion, of the graphic layer. Vertical scrolling means vertically scroll the displayable elements of a graphic layer within the window, or displayable portion, of the graphic layer. In addition, means are provided for varying the x-coordinate and y-coordinate of a sprite, whereby the sprite may be visibly perceived to move upon the video display.

BRIEF DESCRIPTION OF THE DRAWINGS

FIG. 4 of the drawings is a diagram of the 6-bit graphic data format;

FIG. 5 of the drawings is a diagram of the 4-bit graphic data format, showing, in particular, the expansion of 4-bit data to 6-bit data;

FIG. 11 of the drawings is a priority hierarchy diagram, showing, in particular, the relationship between graphic layer and sprite block priorities;

FIG. 12 of the drawings is a depiction of a video screen display, showing, in particular, sprites and graphic layers having priorities as shown in FIG. 11;

FIG. 13-B of the drawings is a portion of a state diagram of the main controller;

FIG. 13-C of the drawings is a portion of a state diagram of the main controller;

FIG. 13-D of the drawings is a portion of a state diagram of the main controller;

FIG. 13-E of the drawings is a portion of a state diagram of the main controller;

FIG. 14 of the drawings is a diagram of the graphic layer controller;

FIG. 16 of the drawings is a diagram of the line buffer controller and surrounding circuitry.

DETAILED DESCRIPTION OF THE DRAWINGS

Figure 9:
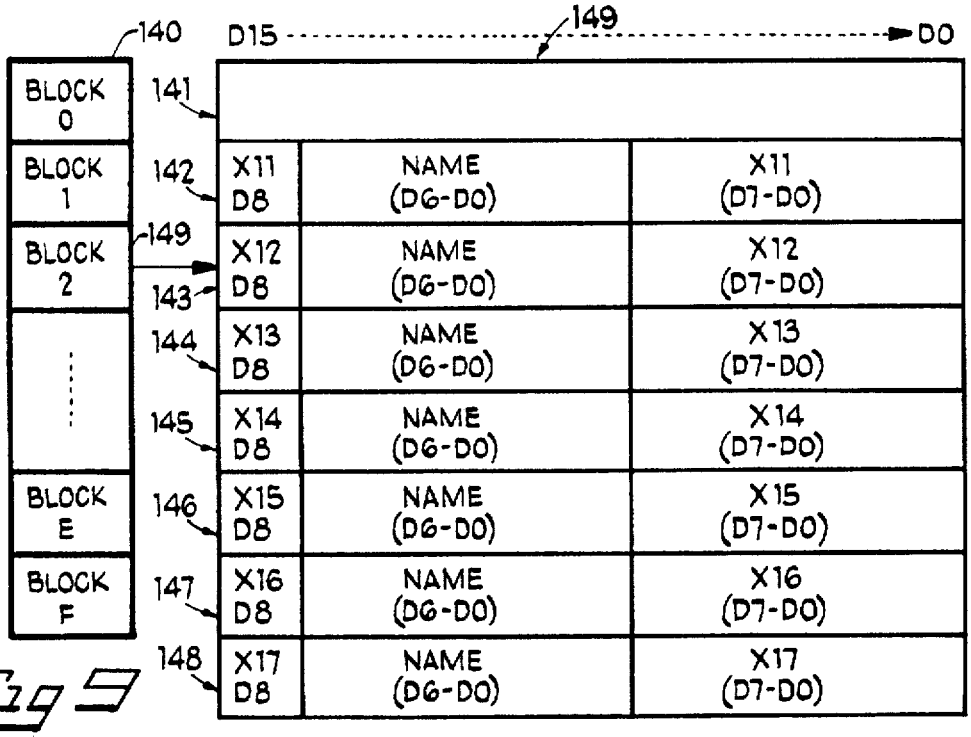
FIG. 9 of the drawings is a diagram of the sprite x/name table.

While this invention is susceptible of embodiment in many different forms, there is shown in the drawings and will herein be described in detail, one specific embodiment, with the understanding that the present disclosure be considered as an exemplification of the principles of the invention and is not intended to limit the invention to the embodiment illustrated.

The present graphic video display system, or graphic video controller supports multiple, overlapping graphic layers and sprites. In particular, three graphic layers, designated layer GR1A, layer GR1B, and layer GR2, respectively, and up to 112 individual sprites are supported.

Associated with each graphic layer is a two-dimensional array of pixels, or displayable elements. For each graphic layer, a separate region of memory stores a bit-mapped graphical representation of data to be displayed. For each displayable element within a graphic layer a 4-bit (for layers GR1A and GR1B) or 6-bit (for layer GR2) value specifies a color to be displayed at a corresponding pixel location on a video display.

Each graphic layer includes a programmable window. Rather than displaying the entire contents of a graphic layer, a subset, or window, may be designated for display. For each graphic layer, a corresponding window is defined by specifying the locations of horizontal and vertical boundaries, which, together, form a rectangular region. The area within the rectangular region is the displayable window portion of the associated graphic layer.

In addition, graphic data displayed within a window may be horizontally and vertically scrolled. Scrolling does not cause a window to move, but instead causes horizontal or vertical movement of the graphic data visibly perceived on the video display within a particular window.

A line buffer is employed to "build" a picture to be displayed. An image is generated on the video display by sequentially drawing each of 256 horizontal scan lines. Once a 256 line screen has been completely drawn, it is immediately redrawn. The visual persistence of the pixels on the screen are such that, to the human eye, this line-by-line drawing is not perceived and a stable image is perceived.

Before each horizontal scan line is displayed, its contents is generated by the present graphic controller. The graphic controller determines whether a portion of a graphic layer window or sprite overlaps with the current horizontal scan line. If so, the overlapping portion is placed into a line buffer, at a location corresponding to the horizontal position designated for the window or sprite.

Since the present graphic controller supports multiple, positionable windows and sprites, overlap of these objects may occur. Whenever such overlap occurs, priority resolution must take place to determine which of the overlapping portions is to be displayed (i.e., which portion is "on top") at the regions of overlap.

Within the present graphic controller, priority values are used to resolve these apparent conflicts of overlapping objects. Each of the graphic layers has a programmable priority value. Each sprite has a fixed priority value. Objects which overlap with the current scan line are sequentially written to the line buffer in order of increasing priority value. As a result, lower priority objects are obscured by portions of overlapping higher priority objects. When all objects overlapping the current horizontal scan line have been written to the line buffer, the contents of the line buffer is ready to be displayed.

A host processor is interfaced to the present graphic controller. The host processor fills the memory regions storing graphic layer and sprite data with desired values so that desired images may be displayed. In addition, registers within the present graphic controller which control the sizing and positioning of graphic layers windows, the priority of graphic layers, the positioning of sprites, and a palette of colors to be displayed, are all programmable (i.e., individually addressable by the host processor).

Figure 1:
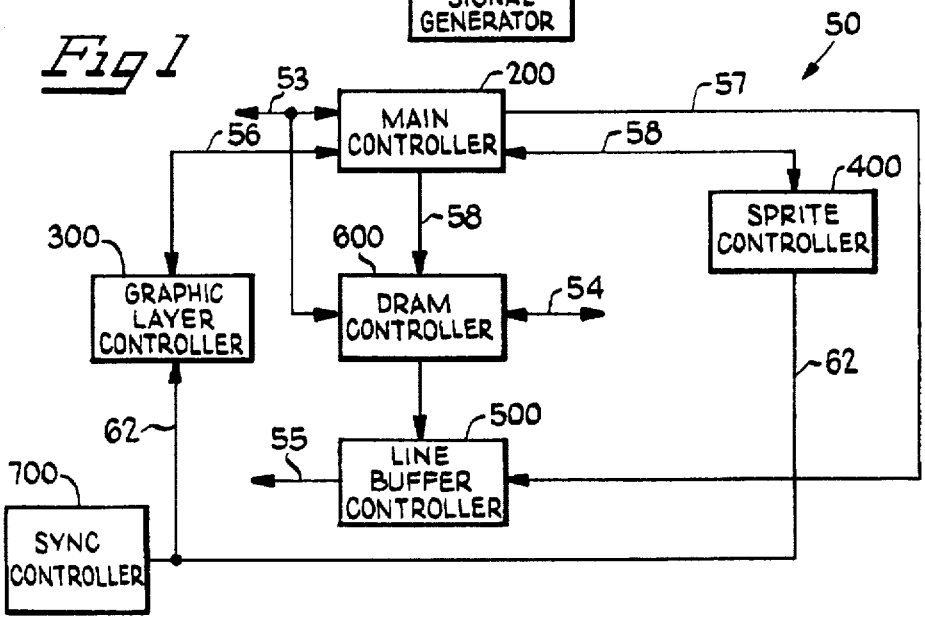
FIG. 1 of the drawings is a diagram of a graphical display system employing the present invention.

Graphic video display controller 50 is shown in FIG. 1 as comprising a main controller 200, a graphic layer controller 300, a sprite controller 400, a line buffer controller 500, a DRAM controller 600, and a sync controller 700. Main controller 200 controls the overall operation of graphic controller 50. The primary function of main controller 200 is to construct each horizontal scan line within a video display. On any given horizontal scan line, one or more graphic layers, as well as one or more sprites, may be present.

For each horizontal scan line, main controller 200 issues commands to graphic layer controller 300 via command lines 56, instructing graphic layer controller 300 to place portions of graphic layers overlapping the current horizontal scan line within a line buffer associated with line buffer controller 500. Similarly, for each horizontal scan line, main controller 200 issues commands to sprite controller 400 via command lines 58, instructing sprite controller 400 to write portions of sprites overlapping the current horizontal scan line to a line buffer.

Main controller 200 transmits commands to DRAM controller 600 via command lines 58, instructing DRAM controller 600 to retrieve various types of data, in various data formats, from an associated dynamic random access memory (DRAM). In particular, DRAM controller 600 accepts commands from main controller 200 to retrieve displayable elements from each of the three graphic layers, to retrieve x coordinates, y coordinates, sprite pattern pointers and sprite pattern data for the 112 possible sprites, and to retrieve a horizontal line offset value for the current scan line. In addition, DRAM controller 600 services general requests for memory accesses from a host processor. DRAM controller 600 is interfaced with a DRAM via a conventional memory interface 54.

Line buffer controller 500 controls the operation of two associated line buffers. These two line buffers operate in a "ping-pong" fashion; while one line buffer is being written to, the other is being scanned as the current horizontal line of the video display. When one line buffer has been completely displayed and the other completely written to, the roles of the two line buffers are reversed by line buffer controller 500. Line buffer controller 500 further contains window mask circuitry, so that only the portion of a graphic layer visible within a designated window is displayed upon the video display.

Sync controller 700 provides overall timing of video-related signals, such as horizontal synchronization and vertical retrace synchronization.

Figure 2:
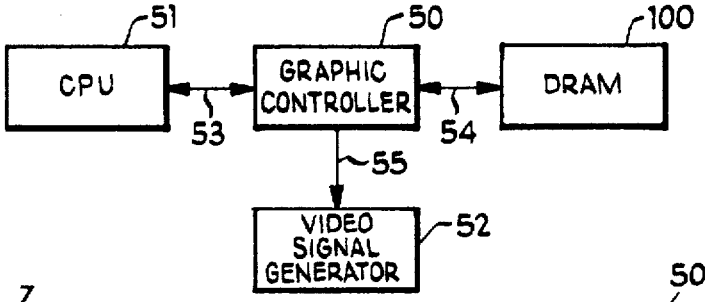
FIG. 2 of the drawings is a diagram of the present graphic display system.

FIG. 2 illustrates an overall video display system incorporating the present graphic controller 50. A typical system incorporating graphic controller 50 includes a host processor, such as CPU 51, which may be a conventional microprocessor, such as a type 68000 microprocessor manufactured by Motorola. CPU 51 commands the operation of graphic controller 50, by loading desired values into the various control registers which govern the operation of graphic controller 50. CPU 51 communicates with graphic controller 50 via a conventional processor interface 53. A dynamic random access memory, DRAM 100, is interfaced to graphic controller 50 via a conventional memory interface 54, and provides storage for graphic layer and sprite data. DRAM 100 also provides general purpose memory for CPU 51. The digital video output 55 of graphic controller 50, in the form of digital data representing the colors of pixels on a video display, is converted to composite video, such as conventional NTSC or PAL video format, via video signal generator 52.

Figure 3:
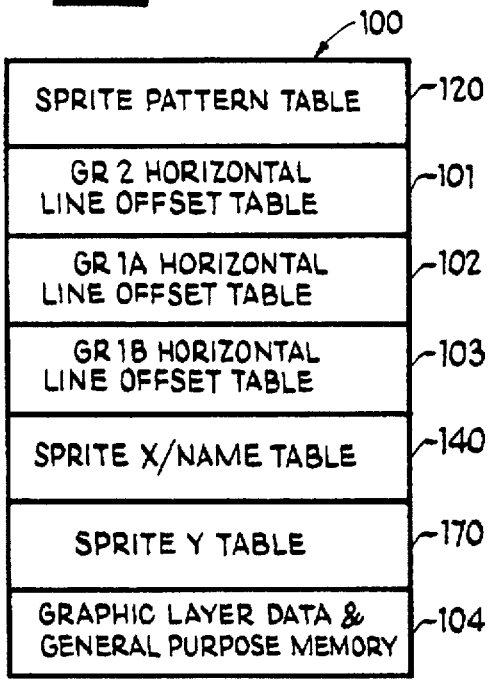
FIG. 3 of the drawings is a diagram of the contents of the dynamic random access memory.

A memory map of the contents of DRAM 100 is shown in FIG. 3. DRAM 100 includes sprite pattern table 120, containing bit-mapped data capable of being displayed as individual sprites on the video display. DRAM 100 further includes horizontal line offset tables 101, 102 and 103 for graphic layers GR2, GR1A, and GR1B, respectively. Each of these horizontal line offset tables is 256 bytes in length, with each entry corresponding to one of the 256 horizontal scan lines on the video display. Each entry provides a value controlling the horizontal scrolling of graphic data within the displayable window portion of the associated graphic layer which overlaps the corresponding horizontal scan line. Sprite Y-table 170 of DRAM 100 contains the Y coordinates of each of the 112 sprites which may be displayed. Similarly, sprite X/name table 140 of DRAM 100 contains an X coordinate and a "name" pointer for each of the 112 displayable sprites. The "name" pointer selects one of 128 16-pixel by 16-pixel graphic patterns within sprite pattern table 120.

DRAM 100 further includes data space 104 for graphic layer data and for general purpose memory available to CPU 51. The specific memory addresses at which each of the three individual graphic layers, GR2, GR1A, and GR1B are stored within graphic layer data and general purpose memory data space 104 is programmable, and is controlled by start block registers and block length registers associated with each graphic layer.

The displayable elements, or pixels, of graphic layer GR2 is stored within DRAM 100 in a 6-bit per pixel data format, as shown in FIG. 4. Eight pixels are stored within every three consecutive words of layer GR2 within DRAM 100. Each of these words is 16 bits in length, with each bit designated D0 (least significant) through D15 (most significant). Each horizontal scan line is 256 pixels in width. Accordingly, 32 consecutive groups of three words are required to store each scan line of layer GR2 data. Each group of three consecutive words comprises a word0 106, a word1 107, and a word2 108. Word0 106 contains the four least significant bits, D3–D0, of the first four pixels, designated pix0, pix1, pix2, and pix3, respectively. Word2 108 stores the four least significant bits of the remaining four pixels of the eight pixel group, designated pix4, pix5, pix6, and pix7. Word1 107 stores the remaining two most significant bits, D5–D4, of pix0 through pix7.

Pixel data for graphic layers GR1A, GR1B, and for sprite pattern data, are all stored in a 4-bit per pixel data format, as shown in FIG. 5. Each consecutive 16-bit word within the portion of DRAM 100 storing graphic data for layer GR1A, GR1B, or sprite patterns contain four 4-bit values, designating the selected colors for four contiguous pixels. Accordingly, 64 consecutive words are required to store each 256-pixel scan line of data for graphic layers GR1A and GR1B. As shown in FIG. 5, each word 110 stores the 4-bit data for a first pixel, designated pix0, a second pixel, designated pix1, a third pixel, designated pix2, and a fourth pixel, designated pix3.

All 4-bit pixel data is converted to a 6-bit format prior to being displayed on a video monitor as a pixel having a particular color. FIG. 5 illustrates the conversion of the pixel designated pix0 from 4-bit to 6-bit format. 4-bit pixel data 113 is divided into two most significant bits 114 and two least significant bits 115. A decoder 111 decodes the two most significant bits 114 to create four selection pointers. Depending upon the value of the bits 114, one of four selection pointers output from decoder 111 is activated. In the example illustrated within FIG. 5, the two most significant bits 114 are presumed to have the digital value "01", activating selection pointer 116. The selection pointers select one of four 4-bit regions within a 16-bit color pointer 112.

Figure 10:
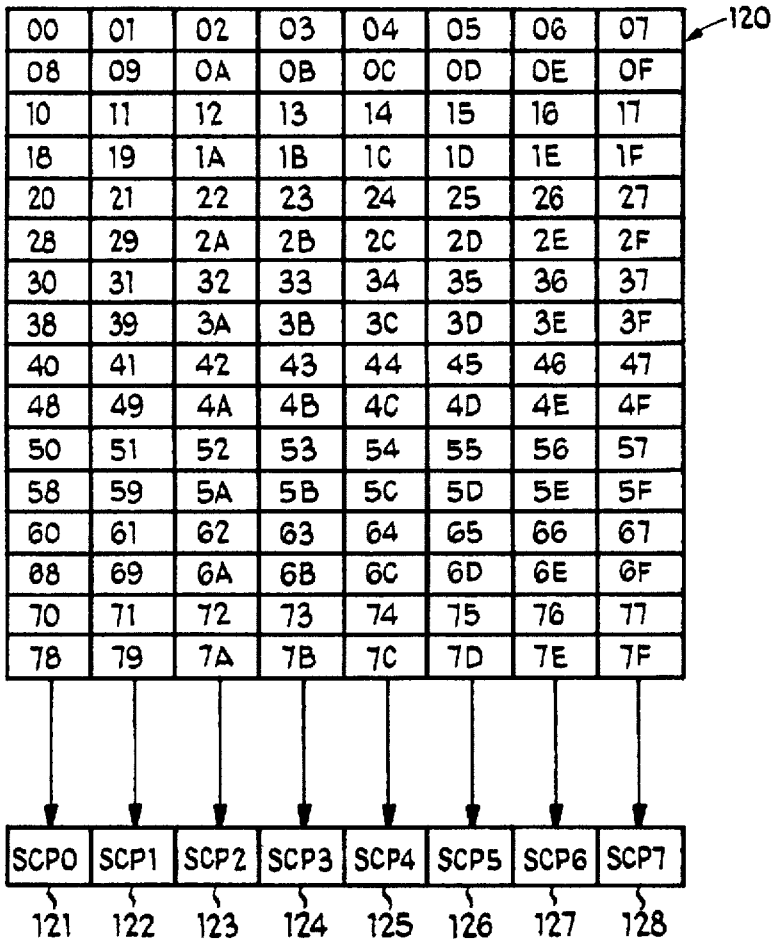
FIG. 10 of the drawings is a diagram of the sprite pattern table and the sprite color pointers.

Color pointer 112 is illustrative of the ten color pointers within the present graphic controller. Each color pointer comprises a 16-bit register. Graphic layers GR1A and GR1B each have a corresponding color pointer. In addition, as shown in FIG. 10, there are eight sprite color pointers, designated SCP0–SCP7, associated with the sprite pattern table. These sprite color pointers are explained in further detail below.

In the example of FIG. 5, active pointer 116 selects bits 11 through 8 of color pointer 112, designated D11–D8, which are read from color pointer 112 as 4-bit data 117. This 4-bit data 117 is combined with the two least significant bits 115 of the original 4-bit data, to create a 6-bit data format 118.

As is shown in FIG. 16 and discussed in further detail below, this 6-bit data, as well as the 6-bit per pixel data of graphic layer GR2, is used as a 6-bit pointer 521 into an array of color registers 580. Color registers 580 include sixty-four 9-bit registers, shown in FIG. 16 as comprising registers numbered 0 through 3F (in hexadecimal notation). A 6-bit pointer 521 selects a specific register number to be read out of color registers 580. A 1-to-1 mapping is used between color pointer 521 and the selected color register of color registers 580. Accordingly, data stored within DRAM 100 in either 6-bit or 4-bit data format is ultimately converted to a 9-bit value for display purposes.

Figure 6:
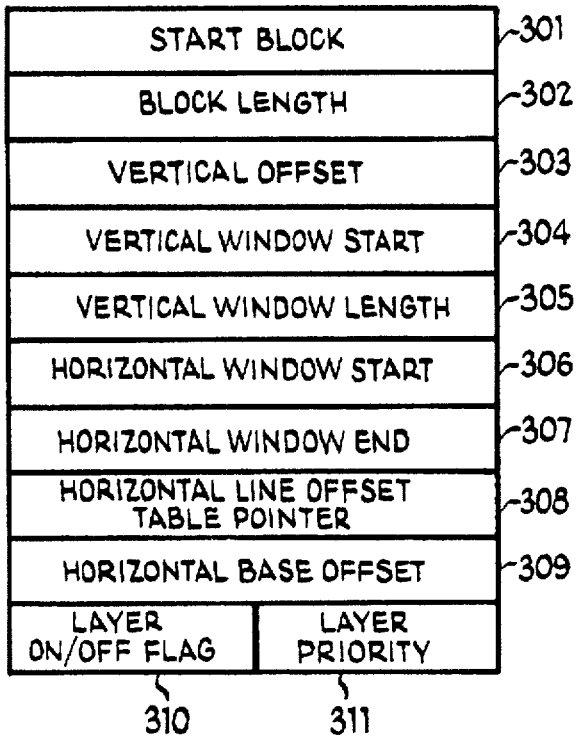
FIG. 6 of the drawings is a diagram of the graphic layer control registers associated with a single graphic layer.

The layer control registers associated with each graphic layer is shown in FIG. 6. For each of the graphic layers GR1A, GR1B, and GR2, there is an associated start block register 301, block length register 302, vertical offset register 303, vertical window start register 304, vertical window length register 305, horizontal window start register 306, horizontal window end register 307, horizontal line offset table pointer 308, horizontal base register 309, layer on/off flag 310, and layer priority register 311.

Start block register 301 specifies the beginning address for the associated graphic layer data within DRAM 100. DRAM 100 is 16-bit word addressable. Start block register 301 is an 8-bit register. An 18-bit address, however, is employed to address graphic layer data within DRAM 100. Accordingly, 8-bit start block register 301 forms the eight most significant bits of the 18-bit DRAM address. The remaining ten least significant bits are zero-filled. Thus, start block register 301 designates the starting address of the associated graphic layer data in 2-kilobyte increments.

Block length register 302 specifies the length, in a quantity of horizontal scan lines, of the associated graphic layer data stored within DRAM 100. Graphic layer data for each graphic layer is thus stored in a continuous block of memory within DRAM 100, starting at the address specified by start block register 301, and continuing for the number of scan lines worth of data specified by block length register 302. As many as 256 horizontal lines may be displayed upon the video screen at a given time. Each of the graphic layers, however, may store up to two screens worth of data. Accordingly, each graphic layer may be up to 512 horizontal lines in length. Nine bits are required to specify a length of up to 512 horizontal lines. Each block length register 302, however, is only 6 bits in length. Block length register 302 is used to specify the six most significant bits of these 9 bits. The remaining three bits are zero-filled. Accordingly, block length register 302 specifies the number of horizontal lines within the associated graphic layer in eight-line increments.

Vertical offset register 303 is employed to control the vertical scrolling of graphic data within the associated graphic layer. As is shown in FIG. 14 and described in further detail below, vertical offset register 303 is used to modify the address generated by graphic layer controller 300 whenever graphic layer data is read from DRAM 100. The contents of a vertical offset register 303 are added to the address presented to DRAM memory when retrieving data for a corresponding graphic layer. Vertical offset register 303 is 9-bits in length, and can specify any single line within the associated graphic layer, which may be up to 512 horizontal lines in size. If vertical offset register 303 is set to a zero-value, there is a 1-to-1 mapping between horizontal scan lines of pixel data stored within the associated graphic layer and horizontal scan lines displayed on the video display. As vertical offset register 303 is increased in value, subsequent pixel data stored within the associated graphic layer is instead retrieved from DRAM 100 as the first line of graphic data to be displayed within the associated graphic layer window. Accordingly, incrementing the vertical offset register 303 results in a visible single scan line vertical scrolling of graphic data within the associated graphic layer window on the video monitor.

Vertical window start register 304 and vertical window length register 305 collectively define the vertical positioning and vertical sizing of the displayable window portion of the associated graphic layer. Vertical window start register 304 and vertical window length register 305 are each 8-bits in length. Vertical window start register 304 specifies the horizontal line number within the 256 line video display which is to be the first visible horizontal line within the associated window of the graphic layer. Vertical window length register 305 specifies the number of horizontal lines visible within the displayable window portion of the associated graphic layer. Only graphic data between the vertical boundaries specified by vertical window start register 304 and vertical window length register 305 may be visible on the video display.

Similarly, horizontal window start register 306 and horizontal window end register 307 collectively define the horizontal positioning and horizontal sizing of the visible window portion of the associated graphic layer. Horizontal window start register 306 and horizontal window end register 307 are each 8-bit registers. Horizontal window start register 306 specifies the particular horizontal pixel position of the 256-pixel wide display at which the visible display window portion of the associated graphical layer begins. Horizontal window end register 307 specifies the horizontal pixel position at which the displayable window portion of the associated graphical layer ends. Only graphic data between the horizontal boundaries specified by horizontal window start register 306 and horizontal window end register 307 may be visible on the video display. As is discussed in further detail below, circuitry within the line buffer controller employs horizontal start register 306 and horizontal end register 307 of each graphical layer in order to generate a "mask" region for each layer, wherein writing of graphic layer data to the line buffer is permitted, in order to generate the associated visible window portion of the graphic layer.

Horizontal base offset register 309, horizontal line offset table pointer 308, and layer horizontal line offset tables 101, 102, and 103 within DRAM 100 collectively control the horizontal scrolling of graphic data within windows corresponding to the three graphic layers of the present graphic controller. Horizontal line offset tables 101, 102, and 103 for graphic layers GR2, GR1A, and GR1B, respectively, are each 256-byte tables. Each entry within a horizontal line offset table corresponds to a single scan line of the 256 displayable lines of the video display. Each entry within a horizontal line offset table controls the horizontal scrolling of the corresponding line of pixels within the corresponding graphic display window. For example, the fourteenth entry within GR2 horizontal line offset table 101 controls the horizontal scrolling of the fourteenth line of graphic layer GR2. If this fourteenth entry is zero-valued, no horizontal scrolling will occur within the portion of the visible window of layer GR2 data which overlaps with the fourteenth horizontal scan line. If however, this fourteenth entry is not zero-valued, layer GR2 data visible on the fourteenth horizontal scan line will be horizontally scrolled, or shifted, a number of pixels equal to the value of the fourteenth entry. Accordingly, each individual horizontal line of pixels displayed within each graphic layer window may be individually horizontally scrolled by varying an individual corresponding entry within a respective line offset table.

Line offset table pointer 308 controls the mapping, or correspondence, between a particular entry within the horizontal line offset table for the associated graphic layer, and a particular horizontal scan line on the video display. If the value within line offset table pointer 308 is zero, there is a direct correspondence between horizontal line offset table entries and horizontal scan lines. For example, the sixth entry within the horizontal line offset table will correspond to the sixth horizontal scan line on the video display. If, however, the contents of line offset table pointer 308 is nonzero, there will be a shift of the correspondence, or mapping, between a particular entry within the horizontal line offset table for the associated graphic layer and a particular horizontal scan line on the video display. For example, assume line offset table pointer 308 is set to a value of two. Now, the third entry within the line offset table will correspond to the first horizontal scan line; the sixth entry within the horizontal line offset table will correspond to the fourth scan line, etc.

Accordingly, line offset table pointer 308 provides a means whereby desired horizontal scroll values can remain in correspondence with associated lines of graphic layer data as the graphic layer data is vertically scrolled. For example, assume the value within vertical offset register 303 is incremented by four in order to vertically scroll graphic data within a graphic layer window by four horizontal scan lines. If the value within line offset table pointer 308 is simultaneously incremented by four, each entry within the horizontal line offset table will remain in correspondence with the same line of graphic layer data. In this manner, vertical scrolling within a graphic layer window will not result in unwanted horizontal scrolling of individual scan lines. Further, the contents of the horizontal line offset table need not be modified whenever vertical scrolling is desired.

Moreover, all of the presently visible horizontal lines within a graphic layer window may be simultaneously horizontally scrolled an equal number of pixels by varying the value contained within the corresponding horizontal base offset register 309. The horizontal scrolling, or positioning of graphic data within the respective window of each line of each graphic layer is determined by the sum of horizontal base offset register 309 and the individual line entries within the associated horizontal line offset table. Thus, the placement of a nonzero value within a horizontal base offset register 309 results in equal horizontal scrolling of all scan lines within the window of a corresponding graphic layer.

Layer on/off flag 310 controls the visibility of the corresponding graphic layer. For example, if the layer on/off flag associated with graphic layer GR2 is set to "off", no portion of graphic layer GR2 will be displayed.

Layer priority register 311 determines the display priority for the associated graphical layer. Each layer priority register 311 is a 4-bit register. Accordingly, each layer may be assigned a priority value from 0 to 15. As is discussed in further detail below with respect to FIGS. 11 and 12, layer priorities dictate whether a particular graphic layer or sprite is displayed at a given position on the video display whenever there is a positional overlap of a portion of multiple graphic layers, or multiple sprites, or combinations of graphic layer and sprites.

Figure 7:
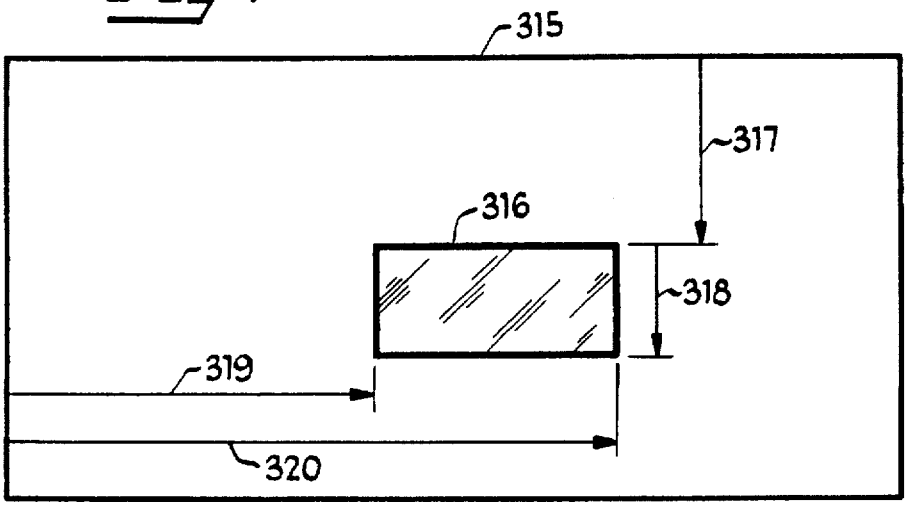
FIG. 7 of the drawings is a depiction of a graphic layer, showing, in particular, the horizontal and vertical sizing and positioning of the graphic layer.

An example of the display of a portion of a graphical layer within a window is shown in FIG. 7. Video display 315 is logically divided in an X-Y coordinate system, with the upper left hand corner being coordinate (0,0), the upper right hand corner being coordinate (255,0); the lower left hand corner being coordinate (0,255); and the lower right hand corner being coordinate (255, 255). A window 316, a visible subset of the displayable elements of a graphic layer, is displayed. The Y coordinate 317 of the top-most edge of window 316 is determined by the corresponding vertical window start register 304. The number of horizontal scan lines 318 within the window is determined by the corresponding vertical window length register 305. The x coordinate 319 of the left-most edge of window 316 is determined by the value within the corresponding horizontal window start register 306. The X coordinate 320 of the right-most edge of window 316 is determined by the corresponding horizontal window end register 307.

For each graphic layer, varying the associated vertical window start register 304, vertical window length register 305, horizontal window start register 306, and horizontal window and register 307 accomplishes two functions; varying these register may vary the horizontal and vertical size of the window displayed within video display 315; alternatively, these values may be altered so as to maintain the overall size of a window 316 while varying the location of the window within display 315.

The present graphic controller supports up to 112 displayable sprites. Each sprite is displayed as a 16-pixel by 16-pixel square on the video monitor. The 112 sprites are logically partitioned into sixteen blocks, designated Block 0 through Block F (in hexadecimal notation). Each sprite block has a fixed priority value corresponding to its block number. Within each sprite block, each of seven successive sprites within the block has a higher priority (for display purposes) than all of the respective previous sprites.

There are three separate data structures associated with the sprite graphics: the Y-table, the X/name table, and the pattern sprite table.

Figure 8:
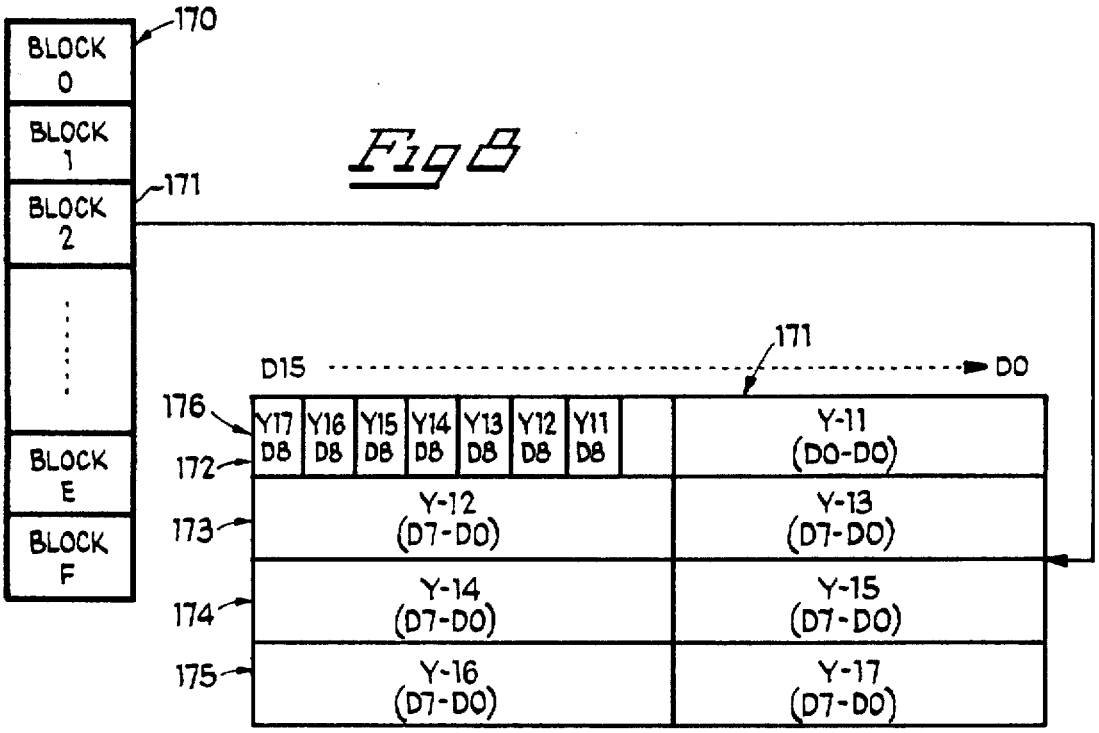
FIG. 8 of the drawings is a diagram of the sprite y-table.
Figure 13E:
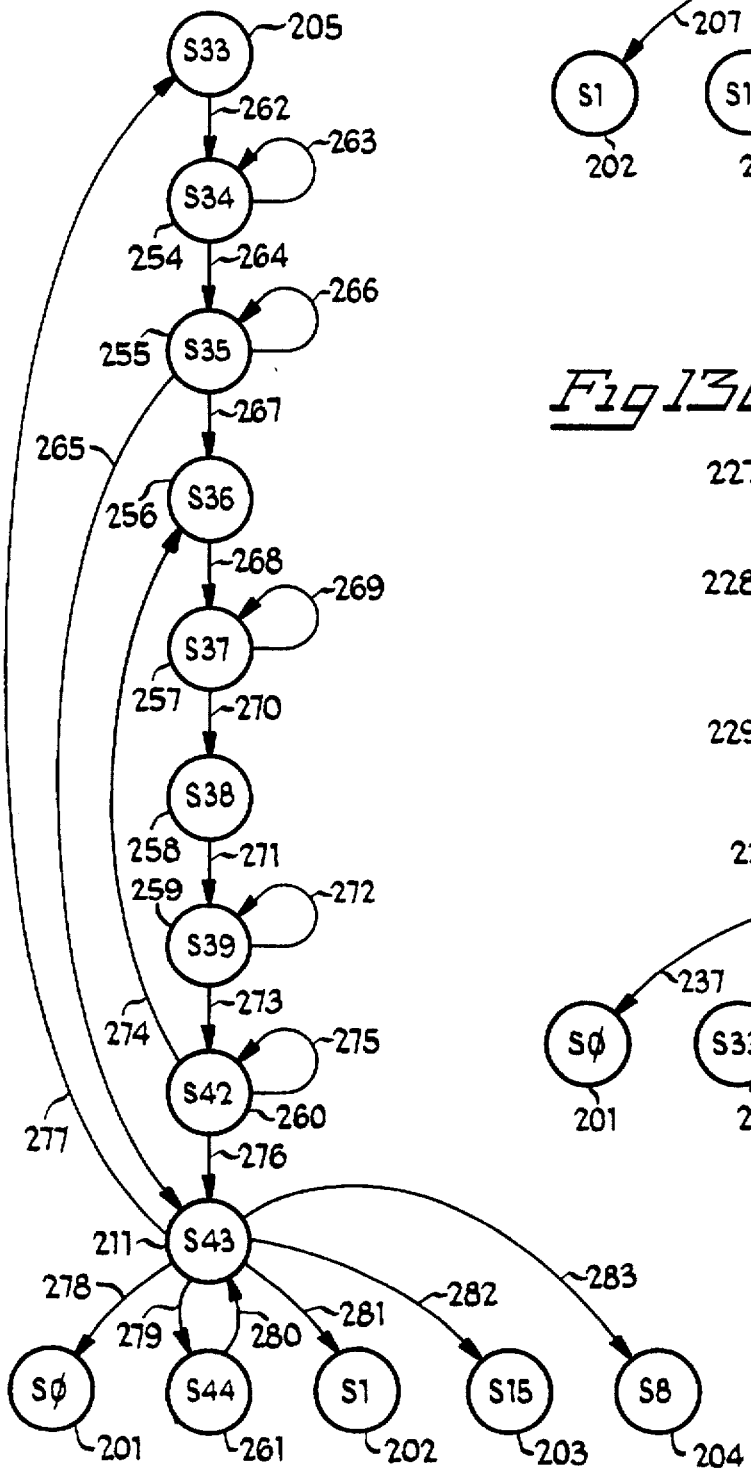
FIG. 13-A of the drawings is a portion of a state diagram of the main controller.
Figure 13A:
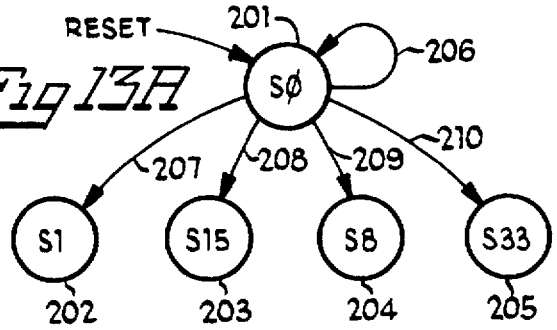
Figure 13C:
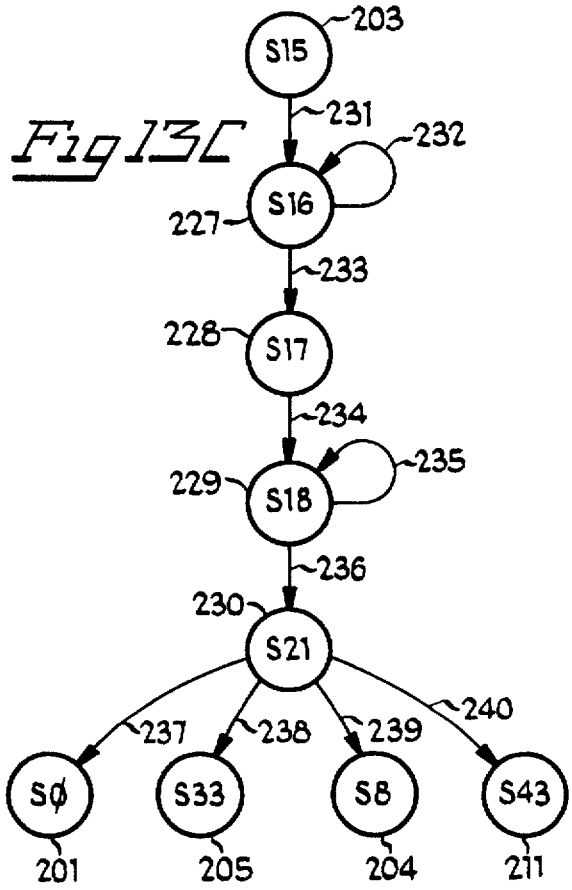
Figure 13B:
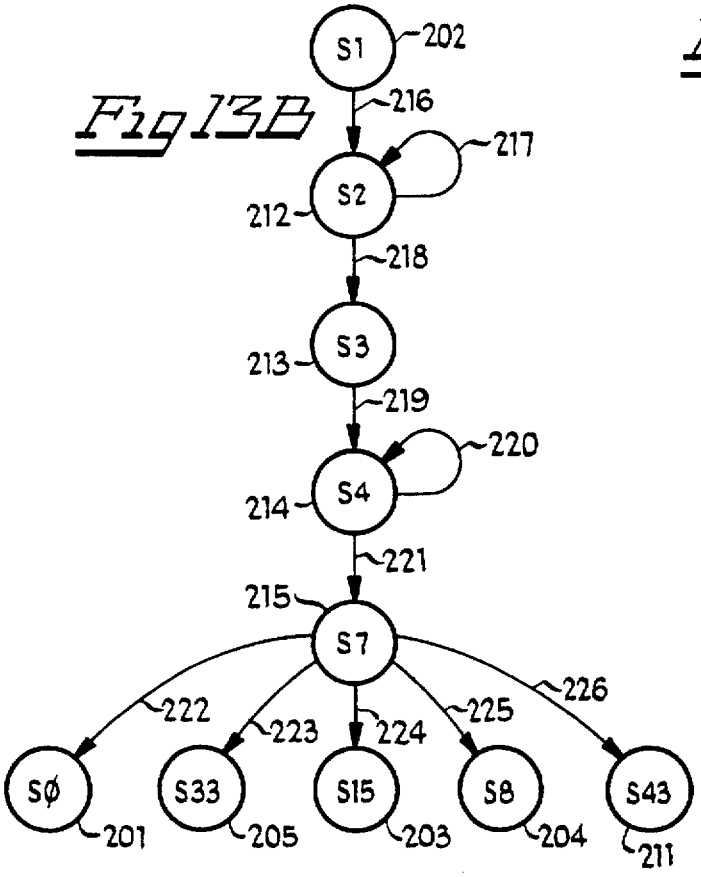
Figure 13D:
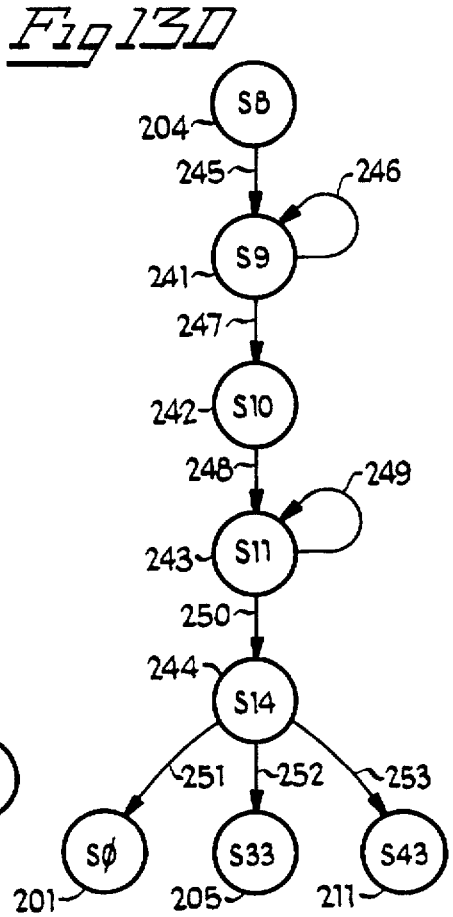

The sprite Y-table data structure 170 is shown in FIG. 8. The 112 Y-table entries, one for each sprite, are stored sequentially within Y-table 170.

The seven entries for sprite block 2 171 are shown in expanded form in order to illustrate the contents of a typical sprite block. The Y coordinate of each sprite is nine bits in length. Each 9-bit Y coordinate specifies the position of the upper left-hand corner of the corresponding sprite within the video display. Since the video display is 256 horizontal scan lines in size, only eight bits are required to specify a Y coordinate for visible display of an associated sprite. Use of a 9-bit sprite Y coordinate within Y-table 170, however, allows individual sprites to be vertically scrolled or positioned off-screen. As described in further detail below, a 9-bit Y coordinate also allows special coordinate values to be assigned to a sprite, which are decoded in order to command the end of processing for the current horizontal scan line of sprites within a given block, or the end of processing for all sprites within all sprite blocks.

An individual sprite block 171 of the Y-table is stored within four consecutive words of DRAM 100. Each word is sixteen bits in length, with each bit designated as D15 (most significant) to D0 (least significant). The first word 172 of each sprite block's Y-table entry stores the eight least significant bits of the Y coordinate of the first sprite within the block. Here, for block 2, this is shown as Y coordinate number Y11, storing bits D7–D0 of the 9-bit Y coordinate for sprite number 11 (hexadecimal). The most significant byte of first word 172 stores the most significant bit, designated D8, of the Y coordinates for all seven sprites within the associated sprite block. Here, for sprite block 2 171, the most significant bits are designated for the Y coordinates of sprite numbers 11 through 17. The second through fourth words of each sprite block's entry within Y-table 170 stores the eight least significant bits of the Y coordinate for the remaining six sprites of the current sprite block. Here, word 173 stores the 8 least significant bits for sprites 12 and 13; word 174 stores the 8 least significant bits for sprites 14 and 15; and word 175 stores the 8 least significant bits for sprites 16 and 17.

The sprite X/name data structure 140 is shown in FIG. 9. For each of the 112 sprites, there is corresponding entry within the X/name table. As with the Y-table, each entry within the X/name table is stored in block-sequence order. As is illustrated in expanded sprite block 2 149 of FIG. 9, the X/name table entries for the seven sprites within each sprite block are stored within eight consecutive words of DRAM 100. A first word 141 is unused. Each successive word stores a 9-bit X coordinate for the corresponding sprite, along with a 7-bit "name" value. The "name" value is a pointer into sprite pattern table 120. For each sprite, the corresponding name value specifies which of the 128 sprite patterns stored within sprite pattern table 120 are to be displayed whenever the sprite is visible. Sprite block 2 includes the X coordinates of sprite numbers 11 through 17 (in hexadecimal notation), designated X1 through X17. Within the X/name table for sprite block 2, word 142 stores the 9-bit X coordinate for sprite number 11, along with a corresponding "name" value. The least significant byte of word 142 stores the eight least significant bits of the X coordinate. The most significant byte of word 142 stores the remaining, most significant bit of the X coordinate, along with the 7-bit "name" pointer into the sprite pattern table.

Similarly, the remaining six X coordinates and corresponding "name" pointers for the remaining six sprites of sprite block 2 are stored within words 143, 144, 145, 146, 147, and 148.

The use of an individual "name" pointer in association with each sprite allows any of the 128 pattern entries within sprite pattern table 120 to be assigned to any sprite. Moreover, the same sprite pattern can be assigned to multiple sprites.

Sprite pattern table 120 is shown in FIG. 10. There are 128 sprite patterns contained within sprite pattern table 120. As is shown in FIG. 10, each sprite pattern table entry is assigned a unique number, from 00 to 7F in hexadecimal notation. For each of the possible values of the 7-bit "name" pointer, there is a unique sprite pattern table entry. Each sprite is visibly displayed as a 16-pixel by 16-pixel square on the video display. Accordingly, each sprite pattern includes 256 pixels. These 256 pixels are stored in 4-bit per pixel data format within sprite pattern table 120, as shown in FIG. 5. A total of 1,024 bits is thus required to store all of the pixel data for a given sprite. These 1,024 bits are stored as groups of 64 consecutive 16-bit words within sprite pattern table 120.

Eight sprite color pointers are associated with sprite pattern table 120. The three least significant bits of the sprite pattern table entry number is decoded in order to determine the associated sprite color pointer. Sprite patterns with numbers ending in "000" (binary) are assigned to sprite color pointer SCPO 121. Sprite patterns with number ending in "001" (binary) are assigned to sprite color pointer SCP1 122. Sprite patterns with names ending in "010" (binary) are associated with sprite color pointer SCP2 123. Sprite patterns with names ending in "011" (binary) are assigned to sprite color pointer SCP3 124. Sprite patterns with names ending in "100" (binary) are associated with sprite color pointer SCP4 125. Sprite color patterns with names ending in "101" (binary) are associated with sprite color pointer SCP5 126. Sprite patterns with names ending in "110" (binary) are associated with sprite color pointer SCP6 127. Sprite patterns with names ending "111" (binary) are associated with sprite color pointer SCP7 128. Each sprite color pointer is a 16-bit register. As is explained above, and as is shown in FIG. 5, 4-bit per pixel sprite pattern data is read out of the sprite pattern table, decoded, and combined with the associated sprite color pointer in order to create 6-bit data for indexing into the color registers towards eventual display on the video display.

Each graphic layer is assigned a four-bit priority value, which may be set anywhere from 0 to F hexadecimal, according to the contents of its corresponding layer priority register 311. Each sprite however, has a fixed priority, depending upon the sprite block within which the sprite is located, as well as the position of the sprite within the particular sprite block. Sprites are divided into 16 blocks, designated sprite block 0 through sprite block F. Sprite block F has the highest priority, sprite block 0 has the lowest. In relation to the programmable priority values assigned to the graphic layers, all of the sprites have a priority value equal to their block number, and are displayed above graphic layers having a priority value equal to or less than their sprite block number. With respect to other sprites, within each sprite block, the larger the sprite number, the higher the sprite priority.

The relative priority of the sprites and graphic layers determines, in the case of overlapping portions of graphic layers or sprites, what is displayed on the video display.

The present graphic display system supports "transparent color" for both the sprites and the graphic layers. If the 6-bit value (for graphic layer GR2) or 4-bit value (for sprite patterns and graphic layers GR1A and GR1B) stored within DRAM for a given pixel of a sprite or a graphic layer is equal to zero, the pixel is considered to be a transparent pixel. A transparent pixel is not displayed on the video display. Rather, a portion of a graphic layer or a sprite having transparent color is not written to the video display, and instead objects beneath, either in the form of a sprite, a graphic layer, or the background color, are instead visible upon video display.

If a particular pixel of a graphic layer or a sprite is not a transparent color, but is instead assigned a visible display color (i.e., is nonzero), whether that particular pixel is actually displayed on the video monitor will depend upon the priority assigned the corresponding graphic layer or sprite. At any given pixel position of the graphic display, the highest priority sprite or graphic layer occupying the particular position will be displayed.

If any of graphic layers GR1A, GR1B and GR2 are assigned the same values within their corresponding priority registers 311, the apparent conflict is resolved by presuming layer GR1A to have the highest relative priority, followed by layers GR2 and GR1B, respectively.

FIGS. 11 and 12 illustrate an example of the assignment of specific priority values to each graphic layer, and a potential resultant video display from such a priority assignment. FIGS. 11 and 12 show how the assignment of particular values to graphic layers causes the layers to be logically "inserted", or interspersed, between the fixed priority sprites. In FIGS. 11 and 12, graphic layer GR2 is assigned, as an example, a priority value of zero, and is accordingly the lowest priority display object, immediately below the sprites of block 0, (which also have a priority value of zero). Sprite block 0 71, is displayable immediately above graphic layer GR2. Graphic layer GR1A 72 is assigned a priority value of 1, immediately below sprite block 1 73.

Sprite blocks 1 through E have fixed priority, increasing with sprite number, including sprite block 7 74 and sprite block A 75. Layer GR1B 76, which in FIGS. 11 and 12 is assigned a priority value of F hexadecimal, is displayable immediately below the sprites within sprite block F 77.

FIG. 12 illustrates an example display which may result from this assignment of graphic layer priorities. Graphic layer GR2 70, being assigned a priority value of zero, is the lowest priority object on video display 315, and it is partially obscured by a first sprite within sprite block 0 71, graphic layer GR1A 72, and graphic layer GR1B 76. The first sprite within sprite block 0 71 obscures a portion of graphic layer GR2 70, and is, in turn, partially obscured by graphic layer GR1A 72. Graphic layer GR1A 72 is shown as obscuring a portion of graphic layer GR2 70, partially obscuring the first sprite within sprite block 0 71 and completely obscuring a second sprite within sprite block 0 71. In addition, a portion of graphic layer GR1A 72 is partially obscured by a first sprite within sprite block 1 73. A portion of graphic layer GR1A 72 is also obscured by graphic layer GR1B 76. A portion of a sprite within sprite block 7 74 is shown as being partially obscured by a sprite within sprite block A 75. Graphic layer GR1B 76 is shown as obscuring a portion of graphic layer GR2 70, GR1A 72, a portion of a first sprite within sprite block 1 73, as well as the entirety of a second sprite within sprite block 1 73. A sprite within sprite block F 77, having the highest priority of all objects on the video display, is shown as obscuring a portion of graphic layer GR1B 76.

As described, main controller 200 controls the overall assembly of a video display comprising displayable portions of the three graphic layers and the sprites. Main controller 200 uses a horizontal line counter to sequence through the 256 horizontal scan lines in the video display, from scan line 0 to scan line 255. Main controller 200 also uses a sprite block counter to sequence through the range of priority values, from lowest priority value 0 to highest priority value F, for each scan line. For each current value of the sprite block counter (i.e., the current priority value), graphic layers and sprites having priority values equal to the current priority value, which also have a displayable portion overlapping the present horizontal scan line, are written to the line buffer. Accordingly, objects with lower priorities which are written to the line buffer are subsequently overwritten by other objects of higher priority which overlap the same portions of the current horizontal scan line. In this manner, an entire video display is constructed with objects of lower priority being at least partially obscured by objects of higher priority.

Main controller 200 comprises a state machine. The state diagram for the main controller is shown in FIGS. 13-A to 13-E. Within these figures, states are shown as circles, and transitions from one state to another are shown as arrows.

Referring to FIG. 13-A, state S0 201 is the main controller's "idle" state. State S0 is entered upon a system reset, and at the completion of processing of each line of display data. Within state S0 201, the main controller clears the sprite block counter and waits for a signal from sync controller 700 indicating that horizontal synchronization (i.e., a new scan line) has begun. On each clock cycle until horizontal synchronization is received, path 206 is taken, and the system remains in state S0 201.

Once a horizontal sync has been received, the system will transition to either state S1 202, state S15 203, state S8 204, or state S33 205. If graphic layer GR1B is enabled, as designated by its corresponding layer on/off flag 310, and if the sprite block counter is equal to the present GR1B layer priority, as indicated by its corresponding layer priority register 311, transition 207 will be taken to state S1, and graphic layer GR1B will be processed for the present horizontal scan line.

Similarly, if graphic layer GR2 is enabled and the sprite block counter is equal to the GR2 layer priority, transition 208 will be taken to state S15 203, and graphic layer GR2 will be processed for the current scan line. If graphic layer GR1A is enabled and the sprite block counter is equal to the GR1A priority value, path 209 will be taken to state S8 204, for processing of graphic layer GR1A for the current scan line. Otherwise, if there is no graphic layer enabled whose priority is equal to the present value of the sprite block counter, path 210 will be taken to state S33 205, for display processing of sprites within the sprite block equal to the present value of the sprite block counter.

Graphic layer GR1B processing is shown in FIG. 13-B. Within state S1 202, the main controller issues a command to the DRAM controller to retrieve the GR1B horizontal line offset for the present scan line from the GR1B horizontal line offset table 103. Transition 216 is then taken to state S2 212. Within state S2, path 217 is taken, and the system remains within state S2, until a signal is received from the DRAM controller that the horizontal line offset has been retrieved. Upon receipt of this signal from the DRAM controller, transition 218 is taken to state S3 213. Within state S3, a command is issued to the graphic layer controller and the DRAM controller to process graphic layer GR1B for the current horizontal scan line. The graphic layer controller determines whether a portion of the displayable elements within the vertical boundaries of the layer GR1B window overlaps with the current horizontal scan line. If so, the DRAM controller retrieves all 256 displayable elements of graphic layer GR1B corresponding to the current horizontal scan line. Transition 219 is next taken to state S4 214. Within state S4, the system waits for the receipt of a signal from the DRAM controller, indicating that the entire scan line of GR1B layer data has been processed by the graphic layer controller. Path 220 is taken to remain in state S4 until this signal is received from the DRAM controller. Upon receipt of this signal from the DRAM controller, transition 221 is taken to state S7 215. Within state S7, a series of tests are executed to determine what subsequent processing is required. If all three graphic layers have already been processed, and a signal is received from sprite controller 400 that either sixteen sprites (the maximum allowed on a single horizontal scan line) have already been written to the line buffer for the present horizontal scan line (as indicated by output 471 of sprites-written counter 470), or ycode 441 (a 2-bit status flag received from the sprite controller) is set to "00" (binary) (as indicated by output 441 of Y discriminator 440), then processing for the present horizontal scan line is deemed to be completed, and transition 222 is taken to state S0 201, where the system remains idle until a subsequent horizontal synchronization signal is received from the sync controller. If all graphic layers have been processed, but either sixteen sprites have not been written for the present horizontal scan line or ycode is not equal to "00" (binary), transition 223 is taken to state S33 205, and the sprite block corresponding to the present value of the sprite block counter will be processed. Otherwise, if graphic layer GR2 is enabled and the sprite block counter is equal to the graphic layer GR2 priority register contents, transition 224 is taken to state S15 203 for processing of layer GR2 data. If graphic layer GR1A is enabled and the sprite block counter is equal to the GR1A priority value, transition 225 is taken to state S8 204, for processing of layer GR1A data. Otherwise (i.e., all graphic layers have not been processed, but none have priority values equal to the present value of the sprite block counter), if the output of sprites-written counter 470 indicates that sixteen sprites have not been written to the present horizontal scan line, and if the output of the Y discriminator indicates that the ycode is not equal to "00" binary, transition is taken to state S33 for processing of the sprite block corresponding to the present value of the sprite block counter. If none of the above conditions are met, transition 226 is taken to state S43 211, in order to increment the sprite block counter.

Graphic layer GR2 processing is shown in FIG. 13-C. Within state S15 203, the main controller issues a command to the DRAM controller to retrieve the GR2 horizontal line offset for the present scan line from the GR2 horizontal line offset table. Transition 231 is then taken to state S16 227. Within state S16, path 232 is taken, and the system remains within state S16, until a signal is received from the DRAM controller that the horizontal line offset has been retrieved. Upon receipt of this signal from the DRAM controller, transition 233 is taken to state S17 228. Within state S17, a command is issued to the graphic layer controller and the DRAM controller to process graphic layer GR2 for the current horizontal scan line. The graphic layer controller determines whether a portion of the displayable elements within the vertical boundaries of the layer GR2 window overlaps with the current horizontal scan line. If so, the DRAM controller retrieves all 256 displayable elements of graphic layer GR2 corresponding to the current horizontal scan line. Transition 234 is next taken to state S18 229. Within state S18, the system waits for the receipt of a signal from the DRAM controller, indicating that the entire scan line of GR2 layer data has been processed by the graphic layer controller. Path 235 is taken to remain in state 229 until this signal is received from the DRAM controller. Upon receipt of this signal from the DRAM controller, transition 236 is taken to state S21 230. Within state S7, a series of tests are executed to determine what subsequent processing is required. If all three graphic layers have already been processed, and a signal is received from sprite controller 400 that either sixteen sprites have already been written to the line buffer for the present horizontal scan line (as indicated by output 471 of sprites-written counter 470), or ycode 441 is set to "00" (binary) (as indicated by output 441 of y discriminator 440), then processing for the present horizontal scan line is deemed to be completed, and transition 237 is taken to state S0 201, where the system remains idle until a subsequent horizontal synchronization signal is received from the sync controller. If all graphic layers have been processed, but either sixteen sprites have not been written for the present horizontal scan line or ycode is not equal to "00" (binary), transition 238 is taken to state S33 205, and the sprite block corresponding to the present value of the sprite block counter will be processed. Otherwise, if graphic layer GR1A is enabled and the sprite block counter is equal to the GR1A priority value, transition 239 is taken to state S8 204, for processing of layer GR1A data. Otherwise (i.e., all graphic layers have not been processed, but none have priority values equal to the present value of the sprite block counter), if the output of sprites-written counter 470 indicates that sixteen sprites have not been written to the present horizontal scan line, and if the output of the y discriminator indicates that the ycode is not equal to "00" binary, transition is taken to state S33 for processing of the sprite block corresponding to the present value of the sprite block counter. If none of the above conditions are met, transition 240 is taken to state S43 211, in order to increment the sprite block counter.

Graphic layer GR1A processing is shown in FIG. 13-D. Within state S8 204, the main controller issues a command to the DRAM controller to retrieve the GR1A horizontal line offset for the present scan line from the GR1A horizontal line offset table. Transition 245 is then taken to state S9 241. Within state S9, path 246 is taken, and the system remains within state S9, until a signal is received from the DRAM controller that the horizontal line offset has been retrieved. Upon receipt of this signal from the DRAM controller, transition 247 is taken to state S10 242. Within state S10, a command is issued to the graphic layer controller and the DRAM controller to process graphic layer GR1A for the current horizontal scan line. The graphic layer controller determines whether a portion of the displayable elements within the vertical boundaries of the layer GR1A window overlaps with the current horizontal scan line. If so, the DRAM controller retrieves all 256 displayable elements of graphic layer GR1A corresponding to the current horizontal scan line. Transition 248 is next taken to state S11 243. Within state S11, the system waits for the receipt of a signal from the DRAM controller, indicating that the entire scan line of GR1A layer data has been processed by the graphic layer controller. Path 249 is taken to remain in state S11 until this signal is received from the DRAM controller. Upon receipt of this signal from the DRAM controller, transition 250 is taken to state S14 244. Within state S14, a series of tests are executed to determine what subsequent processing is required. If all three graphic layers have already been processed, and a signal is received from sprite controller 400 that either sixteen sprites have already been written to the line buffer for the present horizontal scan line (as indicated by output 471 of sprites-written counter 470), or ycode 441 is set to "00" (binary) (as indicated by output 441 of y discriminator 440), then processing for the present horizontal scan line is deemed to be completed, and transition 251 is taken to state S0 201, where the system remains idle until a subsequent horizontal synchronization signal is received from the sync controller. If either sixteen sprites have not been written for the present horizontal scan line or ycode is not equal to "00" (binary), transition 252 is taken to state S33 205, and the sprite block corresponding to the present value of the sprite block counter will be processed. If none of the above conditions are met, transition 253 is taken to state S43 211, in order to increment the sprite block counter.

FIG. 13-E shows the portion of the state machine controlling sprite processing. Within state S33 205, the DRAM controller is commanded to retrieve all of the contents of the sprite Y-table for the sprite block equal to the current value of the sprite block counter, and the sprite controller is commanded to begin processing of the sprites within this block. Transition 262 is then taken to state S34 254. Within state S34, branch 263 is taken, and the system remains in state S34, until a signal is received from the DRAM controller indicating that the entire Y-table entry has been retrieved. At this time, transition 264 is taken to state S35. Within state S35, the 2-bit Ycode flag, output from Y discriminator 440 of sprite controller 400, is tested. If the ycode is equal to "10" (binary), indicating that the present sprite being processed is not on the present horizontal scan line, and if sprite sub-block counter 460 indicates that not all sprites within the present block have been processed, transition 226 is taken and this test is repeated, as the sprite controller continues to process the remaining sprites within the present block. If ycode is equal to "0X" (binary), indicating the end of sprite processing for either the current block or for the entire scan line, or if the sprite sub-block counter indicates that all sprites within the present block have been processed, transition 265 is taken to state S43. Otherwise, if ycode is presently equal to "11" (binary), indicating that the sprite currently being processed overlaps with the present scan line, transition 267 is taken to state S36 256.

Within state S36, a command is issued to the DRAM controller to retrieve the entry within X/name table 140 corresponding to the current sprite being processed, as indicated by the sprite block counter and the sprite sub-block counter. Next, transition 268 is taken to state S37 257, where branch 269 is continually taken until a signal is received from the DRAM controller that the most recent request has been completed. At this time, transition 270 is taken to state S38 258. Within state S38, the DRAM controller is commanded to retrieve the portion of sprite pattern table 120 corresponding to the portion of the sprite pattern, pointed to by the current "name" pointer, that overlaps with the current horizontal scan line. Next, transition 271 is taken to state S39 259, where transition 272 is continually taken, and the system remains in state S39, until a signal is received from the DRAM controller that the requested portion of the sprite pattern has been retrieved. At this time, transition 273 is taken to state S42 260, where the ycode output of the sprite controller is again tested.

If sprites-written counter 470 indicates that sixteen sprites have already been written for the present scan line, or if sprite sub-block counter 460 indicates that all seven sprites within the present block have been processed, or if ycode is equal to "0X" (binary) indicating that no remaining sprites are to be processed for the current block or horizontal scan line, transition 276 is taken to state S43 211, where the sprite block counter will be incremented. If ycode is equal to "11" (binary), indicating that a subsequent sprite within the present sprite block is overlapping with the current scan line, transition 274 is taken back to state S36, for processing of the subsequent sprite. Otherwise, if ycode is equal to "10" (binary), indicating that the next sprite is not overlapping with the current scan line, transition 275 will be taken, and the system will remain within state S42, as sprite controller 400 processes the remaining sprites within the current sprite block.

Within state S43, once the sprite block counter has been incremented, a series of tests is conducted to determine what subsequent processing is required. If all sixteen sprite blocks have been processed, or if all three graphic layers have been processed and either sixteen sprites have been written to the present horizontal scan line or the ycode output of the sprite controller is equal to "00" (binary), processing for the current scan line is deemed to be completed, and transition 278 is taken back to state S0 201. If all graphic layers have not been processed, and if graphic layer GR1B is enabled and its priority value is equal to the present value of the sprite block counter, transition 281 is taken to state S1 202. If all graphic layers have not been processed, graphic layer GR2 is enabled, and the sprite block counter is equal to the graphic layer GR2 priority value, transition 282 is taken to state S15 for the processing of graphic layer GR2. If all graphic layers have not been processed, graphic layer GR1A is enabled, and the graphic layer GR1A priority value is equal to the sprite block counter, transition 283 is taken to state S8204 for processing of graphic layer GR1A data. If none of the above conditions are met for state S43, transition 279 is taken to state S44 261. Within state S44, transition 280 is immediately taken back to state S43. This allows an additional increment of the sprite block counter to take place, and the tests for state S43 are repeated.

FIG. 14 is a diagram of graphic layer controller 300. Specifically, FIG. 14 shows the layer address generation circuitry for one of the three graphic layers, GR1A, GR1B, or GR2. Graphic layer controller 300 contains three sets of the circuitry shown within FIG. 14, one for each graphic layer.

During vertical retrace, i.e., between the generation of individual "frames" of video displays, vertical window start down counter 310 is preloaded with the contents of the vertical window start register 304 for the associated graphic layer. Similarly, vertical window length down counter 320 is preloaded with the contents of the corresponding vertical window length register 305. At the start of each horizontal line, sync controller 700 outputs a horizontal sync pulse 62 to the clock inputs of vertical window start counter 310, vertical window length counter 320, and vertical offset up counter 330. Each horizontal sync pulse 62 received by vertical window start down counter 310 causes the counter to decrement by one. When the contents of vertical window start down counter 310 reach zero, a count enable signal 311 is activated to enable the clock input to vertical window length down counter 320. A window enable signal 312 is also activated, to enable the clock input to vertical offset up counter 330. When the window is enabled, the output 331 of vertical offset up counter 330 is added to the output 361 of the start block register 360 associated with the graphic layer presently being processed. Adder 370 performs this addition, generating output 371.

Accordingly, the window for the associated graphic layer is only enabled when the current horizontal scan line is within vertical boundaries established by the contents of the associated vertical window start register and vertical window length register. At all other times, the window is not enabled, and no graphic layer data will be retrieved from DRAM. DRAM controller 500 issues control signals 60 to increment a horizontal address up counter 350. The output 351 of horizontal address up counter 350, is added to output 371 from adder 370. Adder 380 performs this addition, and output 381 from adder 380 comprises the effective DRAM address for the horizontal line of graphic layer data overlapping the current horizontal scan line. The addition of the contents of vertical offset up counter 330 to the effective DRAM address of graphic layer data to be retrieved provides means for vertically scrolling data within the associated graphic layer, since data corresponding to subsequent horizontal scan lines within the associated data is instead retrieved from DRAM. The retrieved layer data is written to the line buffer by the line buffer controller.

This process continues for each scan line until vertical window length down counter 320 reaches a zero-value. At this time, a control signal 321 is output from vertical window length down counter 320 in order to disable further counting of vertical window start down counter 310, and, in turn, to disable window enables signal 312. This disabling of window enable signal 312 ceases further processing of the associated graphic layer.

Figure 15:
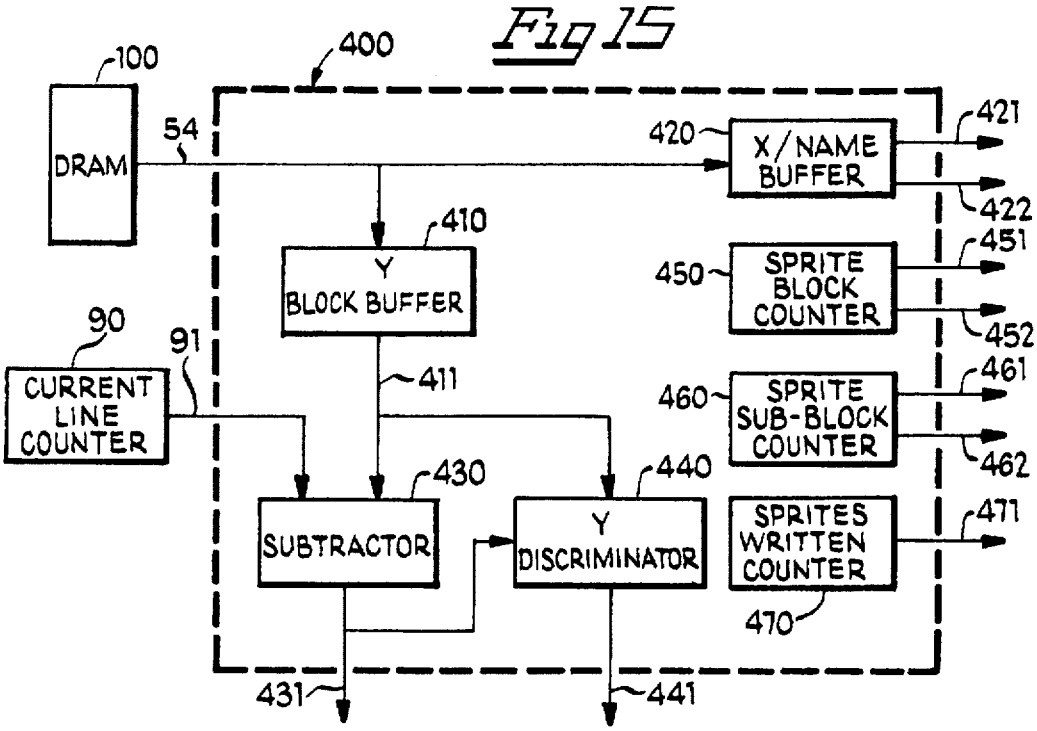
FIG. 15 of the drawings is a diagram of the sprite controller.

The sprite controller 400 is shown in FIG. 15. A sprite block counter 450 counts from zero to fifteen, indicating the current sprite block to be processed, as well as indicating the current priority value for processing of the three graphic layers. Sprite block counter 450 output 451 indicates the present contents of the sprite block counter. Sprite block counter output 452 is a flag indicating whether or not the sprite block counter has reached its maximum value of fifteen.

Sprite sub-block counter 460 indicates the sprite number within the current sprite block being processed. Since each sprite block contains seven sprites, sprite sub-block counter 460 increments from 0 to 6. Output 461 of the sprite block counter indicates the sprite block counter's present value. Output 461 is used, in combination with output 451, to indicate the particular sprite of the 112 possible sprites which is currently being processed. Output 462 of the sprite sub-block counter indicates whether the sprite sub-block counter has reached its maximum value of six (i.e., that all sprites within the present block have been processed). Sprites-written counter 470 tracks the number of sprites which have been written to the present horizontal scan line which is being constructed. A maximum of sixteen sprites may be displayed upon a given horizontal scan line of the video display. Accordingly, sprites-written counter 470 is incremented each time a sprite is written on the current horizontal scan line being constructed. When the value within a sprites-written counter reaches sixteen, flag 471 is asserted.

Y-block buffer 410 receives the entire contents of the sprite Y-table entry corresponding to the current sprite block, as selected by the present value 451 of sprite block counter 450. The DRAM controller, under command from the main controller, performs the reading of this data from DRAM 100. Once the Y-block buffer is filled, the present sprite block is processed. For each Y coordinate 411 within Y-block buffer 410, subtracter 430 subtracts output 91 of horizontal line counter 90 from the current Y coordinate. The output of subtracter 430, called Dy 431, (i.e., the number of scan lines between the current scan line and the value of the Y coordinate) is used by Y discriminator 440 to determine the Ycode, a 2-bit binary status flag for the present sprite. Y discriminator 440 tests the present Dy 431 value and the present Y coordinate 411 in order to determine ycode 441. If the Y coordinate 411 has its two most significant bits set to "10," respectively, ycode is set to "00," indicating that no further sprites or sprite blocks are to be processed for the current horizontal line. If the Y coordinate has its three most significant bits equal to "110," ycode is set to "01" indicating that no further sprites within the current sprite block are to be processed for the current scan line (although sprites within subsequent sprite blocks may still be processed). Accordingly, by assigning special values to the 9-bit Y coordinate which are outside the range of 0–255 (i.e., are not within the range of displayable scan lines), the sprite controller may be instructed to cease further sprite processing.

Otherwise, if Dy is positive and less than or equal to fifteen, then a portion of the 16-by-16 pixel sprite pattern covers the present horizontal associated scan line, and ycode is set to "11" to indicate such. If Dy is not less than or equal to 15, or if Dy is less than 0, no portion of the current sprite overlaps the present horizontal scan line, and ycode is set to "10," indicating that this current sprite does not require further processing for display.

If ycode is equal to "00" or "01", sprite controller 400 will cease processing for the current horizontal scan line or for the current sprite block, respectively. If ycode is equal to "10," sprite sub-block counter 460 will be incremented and the next Y coordinate within Y-block buffer 410 will be processed. If Y code is equal to "11", (i.e., a portion of the current sprite overlaps the current horizontal scan line) this information will be relayed to the main controller, which will command the DRAM controller to retrieve the entry within the sprite X/name table corresponding to the current sprite. This data is temporarily stored within an X/name buffer 420. The X coordinate 421, output from X/name buffer 420, is used to indicate to the line buffer controller the position within the line buffer where the overlapping portion of the sprite pattern is to be written. The "name" 422 output from X/name buffer 420 is used, in conjunction with Dy 431, to retrieve the particular portion of the sprite pattern table corresponding to the horizontal segment of the present sprite which overlaps the current horizontal display line. The "name" 422 value acts as a pointer into the sprite pattern table. The Dy value provides the offset within the selected sprite pattern to the particular one of the sixteen lines within the pattern which overlaps with the current horizontal scan line.

Line buffer controller 500 and its surrounding circuitry are shown in FIG. 16. Line buffer controller 500 controls two distinct line buffers, line buffer 1 510 and line buffer 2 520. Each line buffer is 256 6-bit pixels in length, corresponding to the length of a horizontal scan line. Line buffers 1 and 2 are operated in a "ping-pong" manner. While the contents of one line buffer is being shifted out for display of its contents, the other line buffer is being filled with data to be displayed for the next horizontal scan line. Once the contents of one line buffer has been fully shifted out for display and the other line buffer has been completely filled, the roles of each of the line buffers is reversed. The line buffer formally written to is shifted out for display, while the line buffer previously read for display purposes is written with the next horizontal line's displayable data. In the moment in time illustrated within FIG. 16, line buffer 1 510 is presently being written to with the next line's horizontal data, while line buffer 2 520 is being read for display of its contents. Line buffer read address up counter 570 generates sequential horizontal position addresses 571 into line buffer 2 520, to sequentially read out the contents of line buffer 2. Within each location of line buffer 2, 6-bit per pixel data 521 is read out, and used as a pointer into color register table 580. Color register table 580 has 64 locations, designated 0 through 3F hexadecimal. Accordingly, each possible value of pixel data 521 points to a unique location within color register table 580. Each register within color register table 580 is 9-bits in length. The 9-bit output 581 of the selected entry within color registered table 580 determines the color ultimately displayed on the video screen for the corresponding pixel. Of the nine-bits of data 581, three-bits designate the amount of red light within the color, three-bits designate the amount of green light, and three-bits designate the amount of blue. By combining the specified quantities of red, green, and blue light, any of 512 possible colors may be specified. Output 55 of color registers 580 is connected to a conventional TV signal generator, which converts the 9-bit digital video data to a conventional composite video format, such as NTSC or PAL.

Before the start of each new horizontal scan, each memory location within the line buffer to be written to is initialized to a zero value. This causes each location within the line buffer to initially point to register 0 of color register table 580. This register 0 stores the background color to be displayed. Accordingly, any portion of the line buffer which is not overwritten with a portion of a graphic layer or sprite will display the background color.

A line buffer write address up counter 560 supplies an address 561 for graphic layer and sprite data to be written to line buffer 1 520. Multiplexer 550 supplies data to preset the value of line buffer write address up counter 560. If sprite data is to be written to line buffer 1, multiplexer 550 selects the sprite's X coordinate 421. If graphic layer data is being written to line buffer one, multiplexer 550 selects the output of adder 540. Adder 540 outputs the sum of the contents of horizontal base register 309 for the present graphic layer, plus the contents of the horizontal offset table for the present horizontal line within the present graphic layer being written (as mapped by the line offset table pointer contents). Adder 540 is thus a means for horizontally scrolling the contents of the associated graphic layer window. Since the output of adder 540 comprises the initial address at which graphic layer data will be written to the line buffer, varying the horizontal base register 309 and the corresponding entry within horizontal offset table 530 results in a proportional horizontal shifting of the position at which graphic layer data is written to the line buffer. This, in turn, causes horizontal scrolling of data within the associated graphic layer window.

6-bit data 502, comprising data either from graphic layer GR2, or converted 4-bit data from graphic layers GR1A, GR1B, or sprites, is written to line buffer 1 at the address specified by line buffer write address up counter 560.

The DRAM controller and the graphic layer controller present an entire horizontal scan line of data to the line buffer. Data is only written to the line buffer, however, if it is within the present graphic layer window, and if its color is non-zero, (i.e. it is not a "transparent" color). Graphic layer data is within the present graphic layer window if the output of line buffer write address up counter 561 is greater than or equal to the start of the graphic layer window 511, which corresponds to the value of horizontal window start register 306 for the associated graphic layer. In addition, for graphic layer data to be within the current graphic layer window 513, and in turn, to be written to line buffer 1, the output of line buffer write address up counter must be less than or equal to the close of the window 512, which corresponds to the value within the horizontal window end register 307 for the corresponding graphic layer. Accordingly, line buffer controller 300 tests the contents of these registers to determine whether to assert a write enable signal 501. In this manner, only graphic layer data positioned within horizontal boundaries 513 designated by corresponding horizontal window start and horizontal window end registers will be written to the line buffer. A mask region 513 is thus created within the mask region, graphic layer data may be written.

As graphic layer and sprite pixel data is to be written to line buffer 1, the line buffer controller tests the value of the data to be written. If the value is zero, indicating "transparent color", the data is not written to the line buffer. Instead, lower priority sprites or graphic layer data, or the background color, which have previously been written to the same position within the line buffer, remain within the line buffer and is not overwritten. Accordingly, "holes" may be placed within sprites and graphic layers, to allow lower priority data, or the background color, to "show through".

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A graphic video display system including at least one graphic layer having a two-dimensional array of displayable elements, a subset of which is visually displayable as pixels upon a video display, the video display comprising a plurality of horizontal scan lines including a first horizontal scan line, a last horizontal scan line, and a current horizontal scan line corresponding to a horizontal scan line to be next displayed, the graphic video display system comprising:

a first memory means for storing a digital representation of the displayable elements of the at least one graphic layer;

a second memory means for storing a digital representation of the current horizontal scan line to be next displayed, said second memory means storing only a single horizontal scan line of data at any given time;

horizontal sequencing means for sequencing from the first horizontal scan line to the last horizontal scan line of the video display;

at least one programmable window means for specifying a subset of the graphic layer stored within the first memory means to be displayed, the programmable window means including means for specifying both horizontal boundaries and vertical boundaries of the subset of the graphic layer to be displayed;

means for comparing the value of the current horizontal scan line with the specified vertical boundaries to determine whether a region defined by the specified vertical boundaries of the subset of the graphic layer to be displayed overlaps with the current horizontal scan line;

means associated with the comparing means for reading from the first memory means a region of the graphic layer which overlaps with the current horizontal scan line;

means associated with the reading means for determining a linear segment of the region of the graphic layer read from the first memory means by the reading means which overlaps with the current horizontal scan line and is positioned between the specified horizontal boundaries;

means coupled to the reading means for writing to the second memory means only the segment of the region of the graphic layer read from the first memory means by the reading means which overlaps with the current horizontal scan line and is positioned between the specified horizontal boundaries; and means for displaying an image representative of the current contents of the second memory means upon a corresponding horizontal scan line of the video display;

whereby only the subset of the graphic layer specified as displayable by the programmable window means is displayed upon the video display, as specified by the horizontal and vertical boundaries.

2. The invention according to claim 1 wherein the graphic video display system further includes horizontal scrolling means for horizontally scrolling the displayable elements of a graphic layer within the displayed subset of the graphic layer.

3. The invention according to claim 1 wherein the graphic video display system further includes vertical scrolling means for vertically scrolling the displayable elements of a graphic layer within the displayed subset of the graphic layer.

4. The invention according to claim 1 wherein the graphic video display system includes at least two graphic layers and further includes priority resolving means for determining which of the displayable subsets of the graphic layers are to be displayed on the video display at positions where there is an overlap of the displayable subsets of at least two graphic layers, the priority resolving means comprising:

priority assigning means for assigning one of a range of priority values to each of the graphic layers, the priority values being variable from a lowest priority value to a highest priority value;

priority sequencing means for sequencing from the lowest priority value to the highest priority value, the priority sequencing means having a current priority value; and the displayable subset of a graphic layer which overlaps with the current horizontal scan line being written to the second memory means only when the current priority value is equal to the priority value assigned to the graphic layer;

whereby displayable subsets of each of the graphic layers overlapping the current horizontal scan line are sequentially written to the second memory means in order of increasing priority value, resulting in graphic layers assigned lower priority values being at least partially obscured by overlapping graphic layers assigned higher priority values.

5. The invention according to claim 4 wherein the graphic video display system further includes at least one displayable sprite having an x-coordinate, a y-coordinate, a priority value, and an associated sprite pattern, the graphic display system further including:

means for determining whether a portion of a sprite overlaps with the current horizontal scan line;

means for determining whether a sprite has a priority value equal to the current priority value; and means for writing to the second memory means a subset of a sprite pattern corresponding to the portion of a sprite which overlaps with the current horizontal scan line and which has a priority value equal to the current priority value;

whereby displayable subsets of each of the graphic layers and each of the sprites overlapping the current horizontal scan line are sequentially written to the second memory means in order of increasing priority value, resulting in graphic layers and sprites having a lower priority value being at least partially obscured by overlapping graphic layers and sprites having a higher priority value.

6. The invention according to claim 5 wherein the graphic video display system further includes means for varying the x-coordinate and y-coordinate of at least one sprite, whereby the sprite may be visibly perceived to move upon the video display.

* * * * *